US006170543B1

(12) United States Patent
Simmel et al.

(10) Patent No.: US 6,170,543 B1
(45) Date of Patent: Jan. 9, 2001

(54) CONTROLLED PRODUCT DISPENSING SYSTEM

(75) Inventors: Thomas L. Simmel; Craig A. Baker, both of Milford, CT (US)

(73) Assignee: Link Research & Development, Inc., Milford, CT (US)

( * ) Notice: Under 35 U.S.C. 154(b), the term of this patent shall be extended for 0 days.

(21) Appl. No.: 09/378,182

(22) Filed: Aug. 20, 1999

Related U.S. Application Data

(62) Division of application No. 09/272,988, filed on Mar. 20, 1999, now Pat. No. 5,960,840.
(60) Provisional application No. 60/083,191, filed on Apr. 27, 1998.

(51) Int. Cl.[7] ..... B67D 1/00
(52) U.S. Cl. ..... 141/346; 141/90; 141/349; 141/352; 141/354; 251/149.8
(58) Field of Search ..... 141/1, 18, 90, 141/91, 231, 346, 348–354; 251/149.8; 137/614.02, 614.05

(56) References Cited

U.S. PATENT DOCUMENTS 4,195,672 * 4/1980 Freeman ..... 141/91
5,154,212 * 10/1992 Weber ..... 141/353
5,299,606 * 4/1994 Schrupp ..... 141/91
5,425,404 * 6/1995 Dyer ..... 141/351
5,584,327 * 12/1996 Thomas et al. ..... 141/18
5,651,398 * 7/1997 Decker et al. ..... 141/18
5,765,605 * 6/1998 Waymire et al. ..... 141/18

* cited by examiner

*Primary Examiner*—J. Casimer Jacyna
(74) *Attorney, Agent, or Firm*—Melvin I. Stoltz

(57) ABSTRACT

By providing a securely locked product dispensing valve assembly mounted to a product bearing container which requires a specially constructed cooperating adapter for opening the valve assembly, a controlled dispensing system is realized which provides complete controlled distribution of any desired chemical product. By employing the present invention, only authorized personnel are able to open the container incorporating the valve assembly, enabling the contents to be transferred into only suitable containers incorporating the required adapter for unlocking the valve assembly. As a result, control over the distribution of the chemical product is attained and a completely closed loop, spill-free system is realized. In addition, a rinsing head is provided for being cooperatively associated with the product bearing container and valve assembly to enable complete cleaning of the container prior to recycling.

12 Claims, 26 Drawing Sheets

CONTROLLED PRODUCT DISPENSING SYSTEM

This application is a division of U.S. patent application Ser. No. 09/272,988, filed Mar. 20, 1999 entitled Controlled Product Dispensing System now U.S. Pat. No. 5,960,840, which is related to provisional patent application Serial No. 60/083,191, filed Apr. 27, 1998 entitled Controlled Dispensing System.

TECHNICAL FIELD

This invention relates to product dispensing systems and, more particularly, to product dispensing systems which provide controlled, closed loop transfer of chemicals from one container to a receiving vessel.

BACKGROUND ART

For many years, safe, trouble-free delivery or transferral of various materials, particularly toxic or hazardous materials, has long been a problem which has plagued the industry. In particular, in situations where small quantities of such materials are to be transferred from a storage container to an active, usable reservoir, such as a holding tank wherein the materials are diluted for use, the difficulties typically encountered with transferring these products become most acute.

In an attempt to reduce or eliminate these difficulties, various systems or adaptors have been developed. However, these prior art systems have failed to eliminate or overcome the inherent problems or dangers.

Some of the most acute problems occur with the transferral or dispensing of concentrated chemicals to be added into a diluting solution, typically water, for intermixture therewith and subsequent applications to a particular item or surface. One area in which products of this nature are frequently employed is the agricultural field, which includes commercial and large-scale turf and ornamental applications where grass, plants, and the like are grown for sale or for maintenance. This area also encompasses golf courses, wherein large grass areas must be carefully maintained. However, numerous other areas and industries also require similar systems for the transferral of concentrated chemicals.

In employing these chemical products, extreme care must be exercised due to the concentrated, toxic nature of the fluid materials. In addition, care must be exercised in dispensing these products from a storage vessel to a delivery container or dilution vessel, in order to assure that proper delivery of the concentrated material is achieved, as well as proper dilution and mixing. In many instances, the introduction of excess fluid material into the dilution container can cause an overly concentrated spray to be applied, which can either damage the plants, grass, etc. to which it is applied. In addition, harm to the environment may also result due to the run off of concentrated solutions into ground water supplies.

Although the need for carefully measuring and dispensing such chemical products from a storage vessel to the dilution tank or container has been well known in the prior art, no system has been developed for successfully, efficiently, and repeatedly delivering measured quantities of the concentrated chemical material on a repeatable basis in an easily used system. As a result, the quantities being delivered are not accurate and spillage of the products onto the surrounding area often occurs. These inherent problems have consistently caused difficulties and potential harm to the environment as well as to individuals and has caused less effective concentrations to be applied or used.

In addition, another problem that has plagued this industry is the complexity of prior art constructions. Many prior art chemical product transfer systems are formed from numerous components, requiring expensive manufacturing and assembly costs. Consequently, these systems have not been successful.

Therefore, it is a principal object of the present invention to provide a dispensing system for chemical products which operates in a completely closed manner using only authorized equipment.

Another object of the present invention is to provide a dispensing system for chemical products having the characteristic features described above which is capable of dispensing the entire contents of a container or measured quantities of the concentrated chemical, assuring the transfer of reasonably precise amounts.

Another object of the present invention is to provide a dispensing system having the characteristic features described above which completely eliminates spillage, excessive dosing, and under-dosing.

Another object of the present invention is to provide a dispensing system having the characteristic features described above which is completely safe and operates in an easily employed, error-free manner.

A further object of the present invention is to provide a dispensing system having the characteristic features described above which provides positive, flow control means to assure that the chemical product is delivered only when safe to do so.

Another object of the present invention is to provide a dispensing system having the characteristic features described above which employs a minimum of components and is reasonably easy to assemble.

Another object of the present invention is to provide a dispensing system having the characteristic features described above which employs cooperating, interlocking components, thereby preventing access to chemicals which are not authorized.

Another object of the present invention is to provide a dispensing system having the characteristic features described above which is employable for dispensing liquid products or dry products.

Another object of the present invention is to provide a dispensing system having the characteristic features described above which enables empty containers to be rinsed clean as part of the dispensing operation, thereby further enhancing system efficiency and environmental safety.

Other and more specific objects will in part be obvious and will in part appear hereinafter.

SUMMARY OF THE INVENTION

By employing the present invention, all of the difficulties and drawbacks found in the prior art are completely overcome and a dispensing system is achieved which is capable of producing the transfer of concentrated chemical products from a storage container to a dilution container in a completely closed, spill-free, controlled manner. Furthermore, by employing the present invention, the entire contents of the container can be transferred or, if desired, repeated transfer of measured dosage can be made in order to assure the dispensing of a precise quantity of product from the storage vessel to the dilution container.

In order to attain this controlled, spill-free, dispensing and delivery of any desired chemical product, the present invention employs a product dispensing valve assembly which is securely mounted to a storage container within which the desired chemical product is retained. As discussed above, since such chemical products are often highly concentrated and toxic, the product dispensing valve assembly of the present invention is preferably securely affixed to the portal of the storage vessel in a manner which prevents the removal of the valve assembly from the storage vessel. In this way, controlled distribution of the product from the storage vessel is attained and implemented only by authorized personnel using authorized equipment.

In order to assure the chemical product retained in the storage vessel is distributed only at the desired times, and is otherwise inaccessible, the product dispensing valve assembly of the present invention incorporates closure and locking means which are automatically engaged whenever the product dispensing valve assembly is disengaged from its cooperating adapter. In addition, a mating, specially constructed adapter or coupling is mounted to the dilution container and employed to cooperate with the valve assembly by effectively disengaging the locking means when activated. In this way, assurance is provided that no individual can obtain unauthorized access to the chemical product stored within the closed and sealed container. Only by employing the proper coupling is one able to disengage the locking means of the product dispensing valve assembly of the present invention and activate the distribution of the chemical product from the storage container to the dilution container.

By achieving a securely locked product dispensing valve assembly and a cooperating activating adapter, a controlled dispensing system is realized which provides complete controlled distribution of the desired chemical product by only authorized personnel and only into suitable containers incorporating the required adapter for unlocking the locking means of the valve assembly. As a result, complete control over the distribution of the chemical product is attained. In this way, all of the difficulties and drawbacks found in the prior art have been completely overcome and a controlled distribution system capable of satisfying all of the industry needs and expectations is attained.

In the preferred construction of the present invention, the goals and objectives of the present invention are achieved by constructing the product dispensing valve assembly with a movable valve member which is normally maintained in a closed and sealed configuration in association with a housing forming a part of the valve assembly. In addition, the housing incorporates cam tracks which control the movement of the valve member relative to the housing.

In the preferred construction, the cam tracks require simultaneous arcuate pivoting and axial longitudinal movement of the valve member relative to the housing in order to move the valve member from its closed and sealed position to its open position. In this way, the simultaneous mounting and locking of the valve assembly with a cooperating adapter mounted to a dilution vessel enables the valve member to be opened at the same time the valve assembly and container are securely mounted to the dilution vessel and its associated adapter.

In addition, the cam track construction also preferably incorporates a first zone which causes the valve member to arcuately pivot prior to any simultaneous arcuate pivoting and axial longitudinal movement. In this way, the mounting of the valve assembly to the adapter with an initial arcuate movement is accommodated. Furthermore, the cam track also preferably incorporates a construction which initially resists any arcuate pivoting movement, thereby providing further assurance which prevents unauthorized opening of the valve assembly. This resistance can be achieved employing a wide variety of alternate constructions, such as properly sloping the cam track or incorporating a small raised zone.

A further feature of the present invention is the incorporation of a specially constructed receiving zone formed in the valve member which requires a specially designed pin member to be inserted in the receiving zone for initiating any movement of the valve member relative to the housing. In this way, common tools employed in the industry are incapable of being used to open the valve assembly of the present invention.

Furthermore, the adapter is preferably constructed for mating interengaged relationship with the valve assembly by incorporating a pin member constructed for being inserted into the receiving zones. In addition, the adapter incorporates locking channels for cooperating with the valve assembly for securely locking the valve assembly to the adapter when the container and valve assembly are mounted thereto.

In one embodiment of the present invention, the adapter incorporates a movable plate constructed for cooperative engagement with the valve member for being moved from a closed position to an open position only when the valve assembly is mounted to the adapter and the valve member thereof is activated. In this way, the tank adapter, forming the entry portal to the dilution vessel, is normally maintained in a closed and sealed configuration, preventing addition of any unwanted material into the dilution vessel. However, whenever a product bearing container is mounted to the adapter with the associated valve assembly secured thereto, the adapter automatically opens simultaneously with the opening of the valve assembly.

In accordance with the present invention, both liquid chemical products and dry chemical products are capable of being transferred from storage containers into dilution vessels. By employing the same arcuate pivoting and axial longitudinal movement of the valve member relative to the housing, the present invention is capable of functioning for securely storing both liquid chemical products and dry chemical products in a container with access to the container being prevented until the container and the valve assembly are mounted to a cooperating adapter affixed to a dilution vessel. As a result, the present invention assures a completely controlled, closed loop distribution system for any industry requiring the distribution of concentrated materials and/or toxic chemicals.

In a further aspect of the present invention, the present invention also provides a rinsing system for enabling the user to rinse a container once the container is emptied. In accordance with this invention, the container can be arranged independently of the dilution vessel, in one embodiment or, in the preferred construction, the rinsing head is constructed for being simultaneously interconnected with both the storage container and the dilution vessel for enabling the contents of the container to be emptied into the dilution vessel and rinsed immediately thereafter, without requiring disconnection of the container from the dilution vessel.

Regardless of which embodiment of the rinsing head of the present invention is employed, the rinsing head is constructed for secure, locked, interengaged relationship with the storage container for assuring locked interengagement therewith while simultaneously opening the valve member for enabling the rinsing system to provide the desired water flow through the opened valve assembly into the container. In the embodiment wherein the rinsing head is simultaneously interconnected with the dilution vessel, the rinsing head incorporates a flow-through construction enabling the chemical product to be emptied from the container through the rinsing head and into the dilution vessel and then rinsed clean, with the rinse water flowing into the container and then through the rinsing head into the dilution vessel. In this way, the rinsing process is expedited and a controlled, spill free, environmentally friendly distribution system is attained.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

By referring to FIGS. 1–38, along with the following detailed disclosure, the construction and operation of two alternate embodiments of controlled distribution system 20 of the present invention can best be understood. It is also to be understood that controlled distribution system 20 of the present invention may be constructed in a plurality of further alternate embodiments or constructions not specifically disclosed herein. Consequently, the following embodiment are provided for exemplary purposes only and are not intended as a limitation of the present invention.

By referring to FIGS. 1–5, along with the following detailed disclosure, the construction and operation of product dispensing valve assembly 21 can best be understood. In addition, in FIGS. 6–7, the cooperating tank adapter 22 is depicted and detailed below. As discussed herein, product dispensing of valve assembly 21, in combination with tank adapter 22, cooperate to form controlled distribution system 20 of this invention. By referring to the following detailed discussion, the construction and operation of product dispensing valve assembly 21 and tank adapter 22 can best be understood, as well as their interchangeable co-operation to form controlled distribution system 20.

Figure 1:
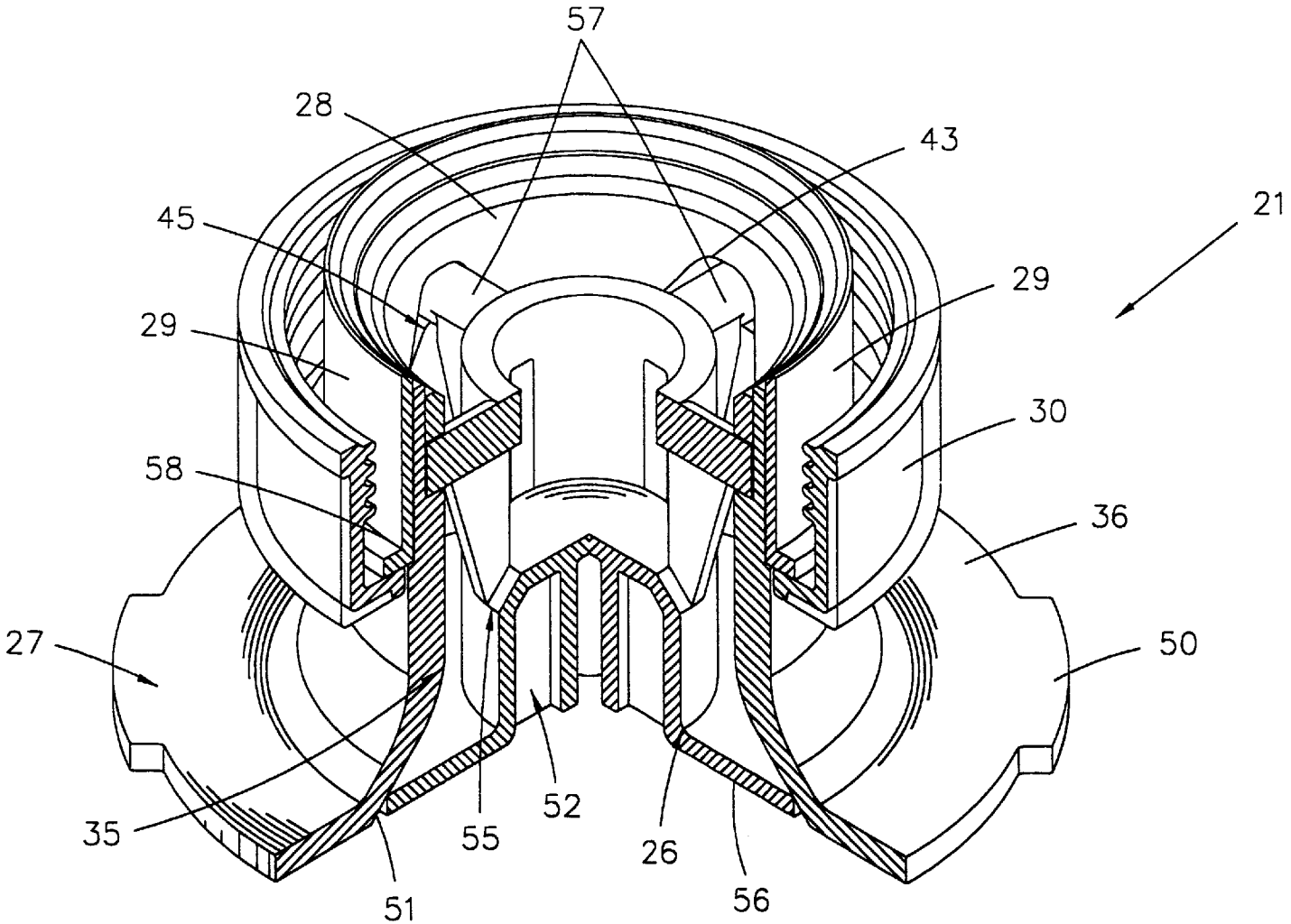
FIG. 1 is a perspective in view, partially in cross-section, of one embodiment of a product dispensing valve assembly manufactured in accordance with the present invention and forming one component of the distribution system of this invention.
Figure 2:
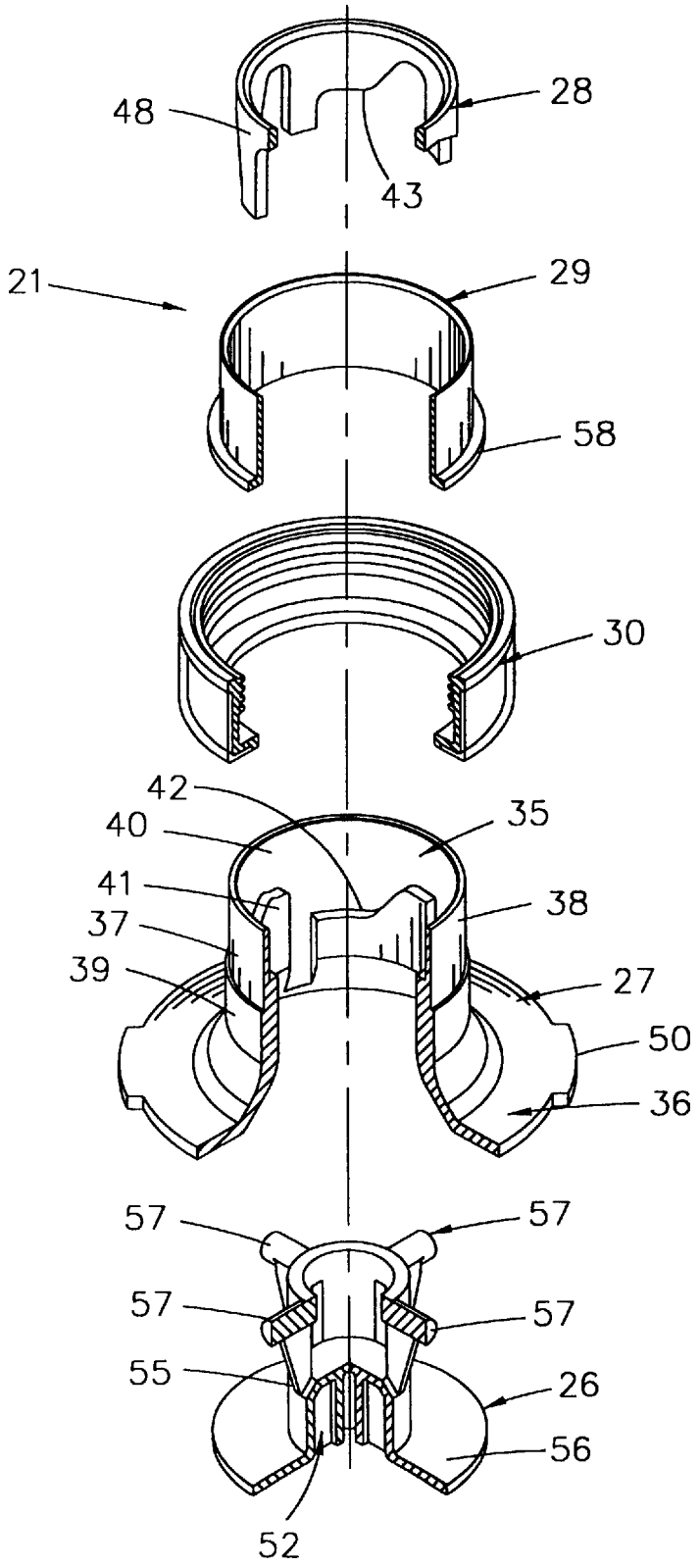
FIG. 2 is an exploded perspective view, partially in cross-section, detailing each of the components employed in forming product dispensing valve assembly of FIG. 1.

As shown in FIGS. 1 and 2, product dispensing valve assembly 21 is formed by mounting valve member 26 in axially movable engagement in housing 27, in captured, cooperating engagement with cam track forming insert 28 and the cam track formed thereby. Product dispensing valve assembly 21 is completed by incorporating adapter 29 in threaded retaining ring 30.

In FIG. 2, the precise construction of each component forming product dispensing valve assembly 21 is fully detailed. As shown therein, housing 27 comprises a hollow, generally cylindrically shaped tube portion 35 which terminates at one end thereof with substantially flat plate portion 36. In the preferred construction of this embodiment, portion 35 of housing 27 comprises a ledge 37 formed on the outer surface thereof circumferentially surrounding tube portion 35 and defining two separate and distinct diameters. By incorporating circumferential ledge 37, tube portion 35 comprises an upper outer wall 38 and a lower outer wall 39, with ledge portion 37 defining the transition therebetween.

Tube portion 35 of housing 27 also incorporates an inner wall 40 on which is formed a plurality of cam surface defining elements 41. Each cam surface defining element 41 radially extends inwardly from inner wall 40, forming a portion of cam track or ledge 42.

In order to complete the formation of each cam track 42, cam track forming member 28 is inserted into tube portion 35 of housing 27 in juxtaposed, spaced, cooperating relationship with cam surface defining elements 41.

As shown in FIG. 2, cam track forming member 28 incorporates a generally-cylindrical shape, having an outer wall 48 and a plurality of cam track forming cut out zones 43 formed therein. Each cut out zone 43 is dimensioned for cooperating with cam track/ledge 42 formed by cam surface defining elements 41.

When cam track forming member 28 is inserted into tube portion 35 of housing 27, outer wall 48 is in abutting contact with the inner wall 40 of tube portion 35 of housing 27, with each cutout zone 43 in juxtaposed, spaced relationship with one cam track/ledge 42. In this way, a plurality of separate and independent cam tracks 45 are formed for controlling the movement of valve 26.

In completing the preferred construction of housing 27, plate portion 36 is formed as a substantially flat circular shaped plate radially extending outwardly from a terminating end of tube portion 35. In this preferred construction, a plurality of locking fins or tabs 50 are formed about the circular terminating edge of plate portion 36, radially extending therefrom for cooperating with tank adapter 22, as detailed below.

In addition, plate portion 36 is interconnected with one terminating end of tube portion 35 at a juncture which incorporates a beveled chamfered zone 51. As detailed below, this beveled or chamfered zone 51 enables valve member 26 to be sealed with housing 27, in order to prevent unwanted flow of the chemical product prior to activation of valve member 26.

In the preferred construction of this embodiment of product dispensing valve assembly 21, valve member 26 comprises a central section 55, a sealing disc 56 mounted to one end of central section 55, and a plurality of radially extending fingers 57 mounted to the opposed end of central section 55. In this construction, radially extending fingers 57 are constructed for being retained in cam tracks 45 of housing 27 in order to control the movement of valve member 26 relative to housing 27.

In addition, the diameter of sealing disc 56 of valve member 26 is constructed for co-operative sealing engagement with beveled or chamfered zone 51 of plate portion 36 of housing 27. In this way, as detailed below, when valve 26 is in the closed position, the contents of any container to which valve assembly 21 is mounted is incapable of being dispensed from the container, until valve member 26 has been moved out of sealed engagement with housing 27 for allowing the contents in the container to flow or move past central section 55 and sealing disc 56.

Figure 3:
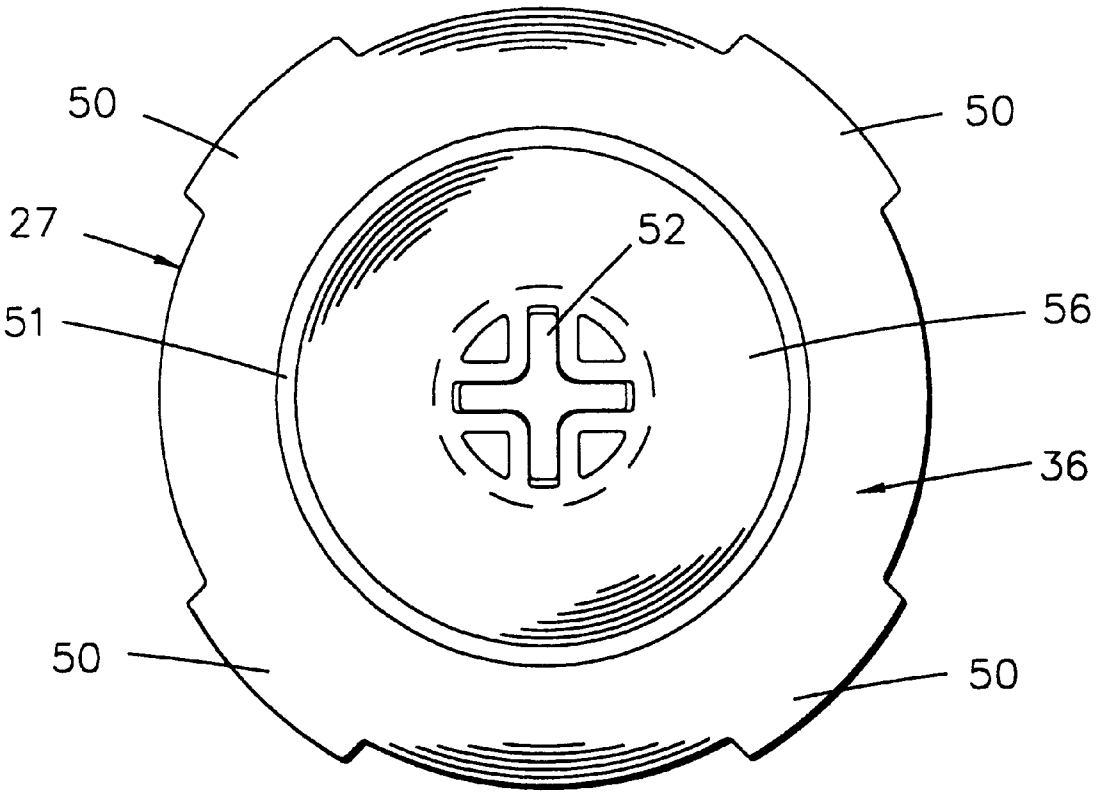
FIG. 3 is a top plan view of the product dispensing valve assembly of FIG. 1.

In order to enable valve member 26 to be controllably movable relative to housing 27, whenever desired by an authorized user, valve member 26 incorporates activating pin receiving zone 52. As best seen in FIG. 3, activating pin receiving zone 52 comprises, in this preferred configuration, a generally "X"-shaped or "T"-shaped recess zone formed in plate portion 36 and extending from the surface of plate portion 36 into tube portion 35.

Generally, any desired shape or configuration can be employed for activating pin receiving zone 52. The principal requirement for pin receiving zone 52 is a configuration which requires a specially designed mating component or pin to be employed and sufficient force receiving contact areas between the pin member and pin receiving zone 52 to cause pivot valve member 26 to pivot relative to housing 27.

As shown in FIGS. 1–4, pin receiving zone 52 is formed by incorporating a plurality of partitions or walls as part of central section 55 of valve member 26. However, any alternate construction or alternate shape, as discussed above, can be employed with equal efficacy.

By employing the overall construction detailed above, a highly effective, easily used product dispensing valve assembly 21 is realized which is capable of providing secured, sealed retention of the chemical products in a container when desired, as well as enabling the chemical product to be easily dispensed from the storage container into a mixing or receiving vessel. As is fully detailed below, in reference to tank adapter 22, the desired controlled activation of valve assembly 21 is realized only when specifically constructed, authorized equipment is employed.

Figure 4:
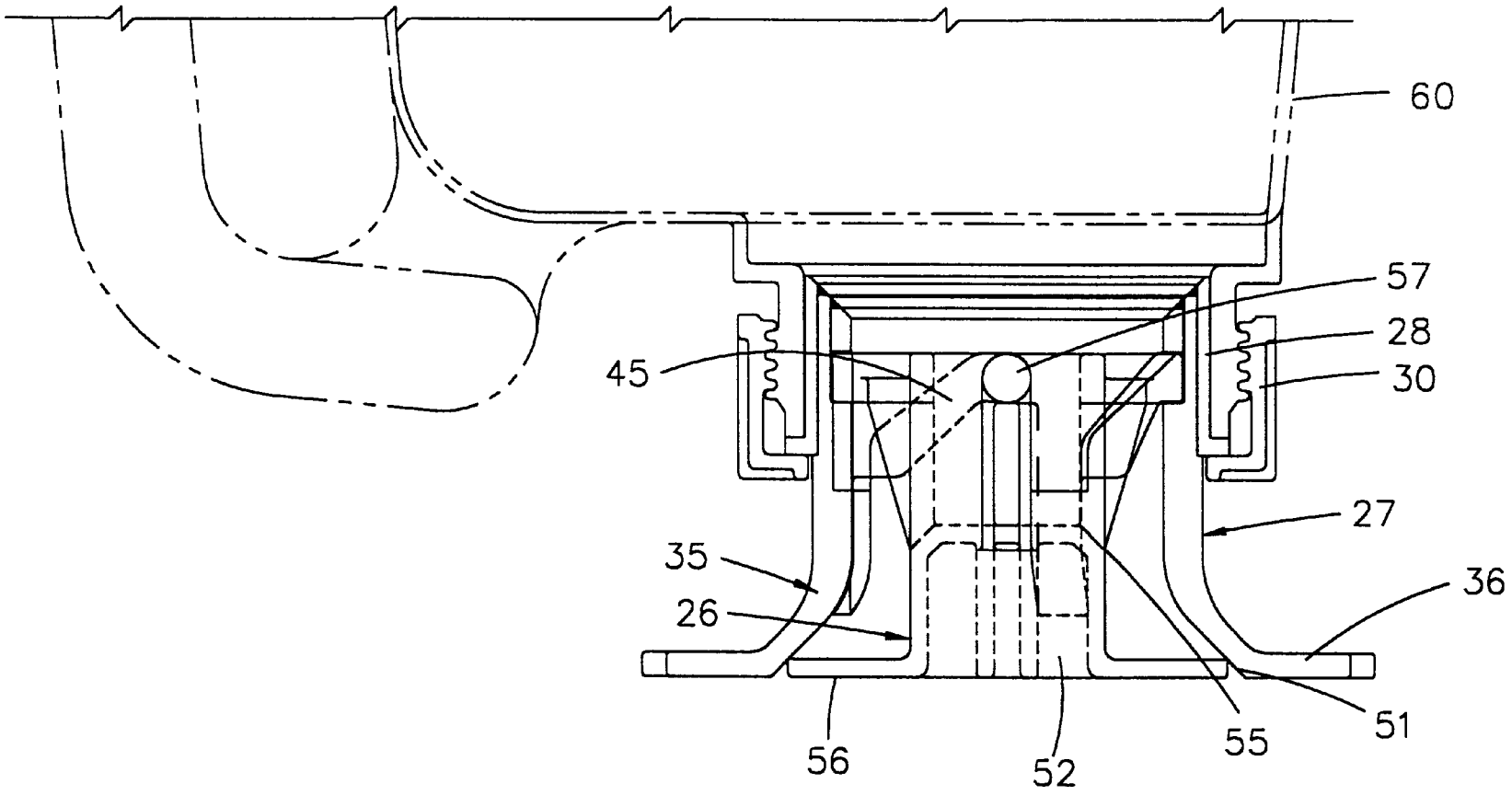
FIG. 4 is a cross-sectional side elevation view of the product dispensing valve assembly of FIG. 1 depicted in its closed position, mounted to a container shown inverted for dispensing the product retained therein.
Figure 5:
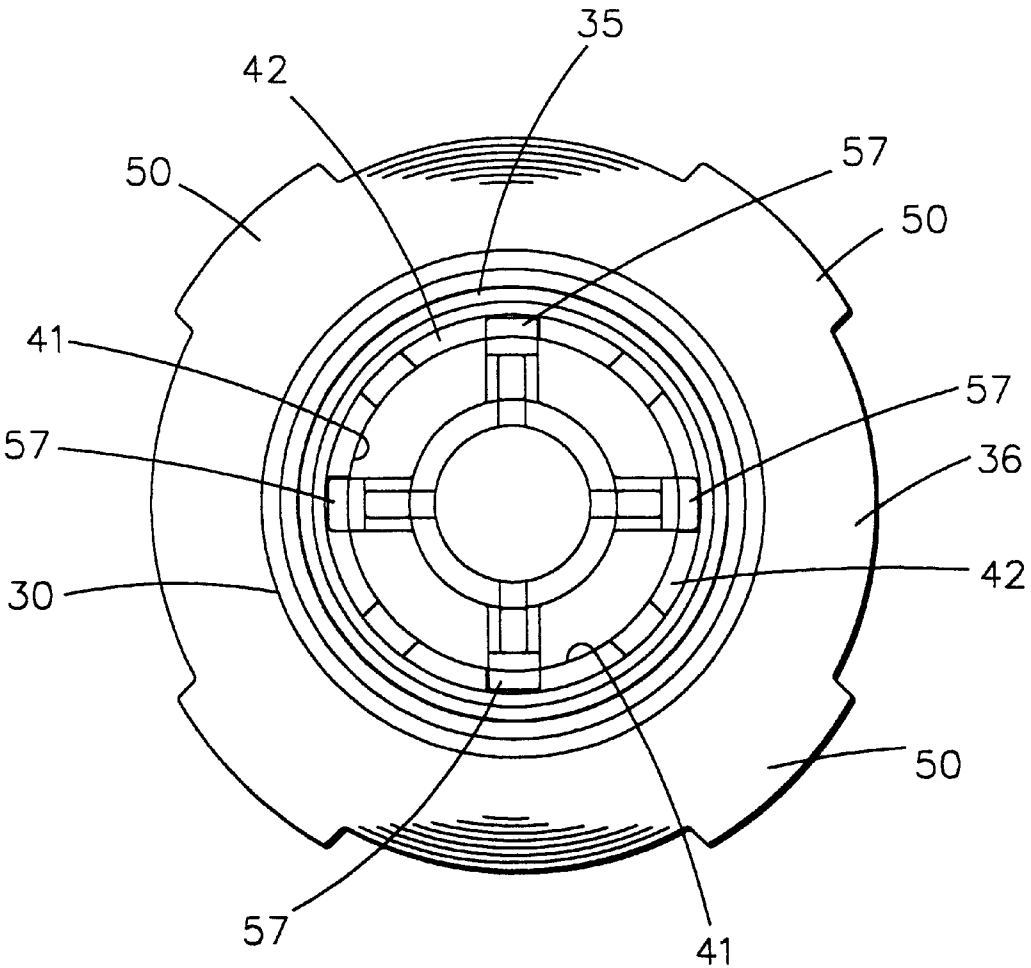
FIG. 5 is a bottom plan of view of the product dispensing valve assembly of FIG. 1.

In FIGS. 3 and 4, product dispensing valve assembly 21 is depicted in the closed, sealed position, with FIG. 4 depicting product dispensing valve assembly 21 mounted to a conventional container 60 within which the desired chemical product is retained. As is evident from the foregoing discussion and the associated Figures, the product retained in container 60 is able to exit from container 60 by passing between the outer surface of central section 55 of valve member 26 and the inside wall of tube portion 35 of housing 27. However, when valve member 26 is in the closed, sealed position, the terminating edge of sealing disk 56 is in direct contact with beveled or chamfered zone 51 of plate portion 36 of housing 27. When in this position, product dispensing valve assembly 21 is effectively closed and the chemical product retained in container 60 is incapable of exiting therefrom.

In order to complete the construction of product dispensing valve assembly 21, threaded sealing ring 30 and adapter 29 are mounted to housing 27. In a typical construction, threaded sealing ring 30 is first mounted to tube portion 35 of housing 27, peripherally surrounding lower outer wall 39 thereof. In the preferred construction, sealing ring 30 is constructed for being axially movable on the outer surface of lower outer wall 39 of tube portion 35 in order to provide ease of attachment of product dispensing valve assembly 21 to any desired container.

Finally, adapter 29 comprises a substantially cylindrical tube constructed for being mounted to housing 27 in peripheral surrounding contact with upper outer wall 38 of tube portion 35. In its preferred construction, adapter 29 incorporates a radially extending flange 58 formed at one end of substantially cylindrically shaped adapter 29, which is brought into direct contact with ledge 37 of tube portion 35 when adapter 29 is in the desired mounted position. Radially extending flange 58 is preferably incorporated into adapter 29 for providing a seal receiving zone for enabling any desired sealing means to be mounted about adapter 29 in contact with flange 58 for providing sealed engagement of the product within the container to which product dispensing valve assembly 21 is mounted.

In order to activate or open product dispensing valve assembly 21, valve member 26 must be moved relative to housing 27 in a manner which causes sealing disk 56 to be moved out of sealing engagement with chamfered or beveled zone 51 of plate portion 36. In the preferred construction of this embodiment, the desired movement of valve member 26 is achieved by simultaneously moving valve member 26 arcuately and longitudinally.

As fully detailed above, radially extending fingers 57 of valve member 26 are mounted in cam tracks 45 of housing 27, thereby controlling the movement of valve member 26 relative to housing 27 to the path defined by cam tracks 45. As a result, valve member 26 is incapable of only axial movement relative to housing 27 and any movement of valve member 26 requires simultaneous arcuate pivoting and longitudinal, axial movement of valve member 26 relative to housing 27. This movement is defined by and controlled by the movement of radially extending fingers 57, as fingers 57 move along cam tracks 45.

As best seen in FIG. 4, the terminating ends of each radially extending finger 57 of valve member 26 are securely mounted in a cam track 45 formed as part of housing 27. As a result, the movement of valve member 26 relative to housing 27 is controlled by the path defined by cam track 45.

As is more fully detailed below in regard to the co-operative engagement of product dispensing valve assembly 21 with tank adapter 22, the activation and movement of valve member 26 initially comprises an arcuate pivoting movement, causing each radially extending finger 57 to arcuately move in the substantially horizontal portion of cam track 45 of housing 27. Once this arcuate movement has been achieved, any further arcuate pivoting motion of valve member 26 causes valve member 26 to simultaneously move longitudinally, along its central axis and the central axis of housing 27. This simultaneous arcuate pivoting motion and longitudinal, axial movement is defined by and controlled by the pathway established by cam track 45. Any such movement continues until radially extending fingers 57 have reached the terminating end of cam track 45.

When in this final, terminating position, sealing disk 56 of valve member 26 is longitudinally displaced forward of chamfered or beveled zone 51 of plate portion 36 of housing 27, establishing a substantial gap therebetween. When in this position, product dispensing valve assembly 21 is open and any chemical product stored in container 60 is capable of being transferred to the associated tank on which the authorized, cooperating tank adapter 21 is mounted. In this way, the desired controlled, spill-free transfer of the chemical product retained in storage container 60 to the dilution vessel or tank is achieved with assurance that only authorized transfer of the chemical product will occur.

Figure 6:
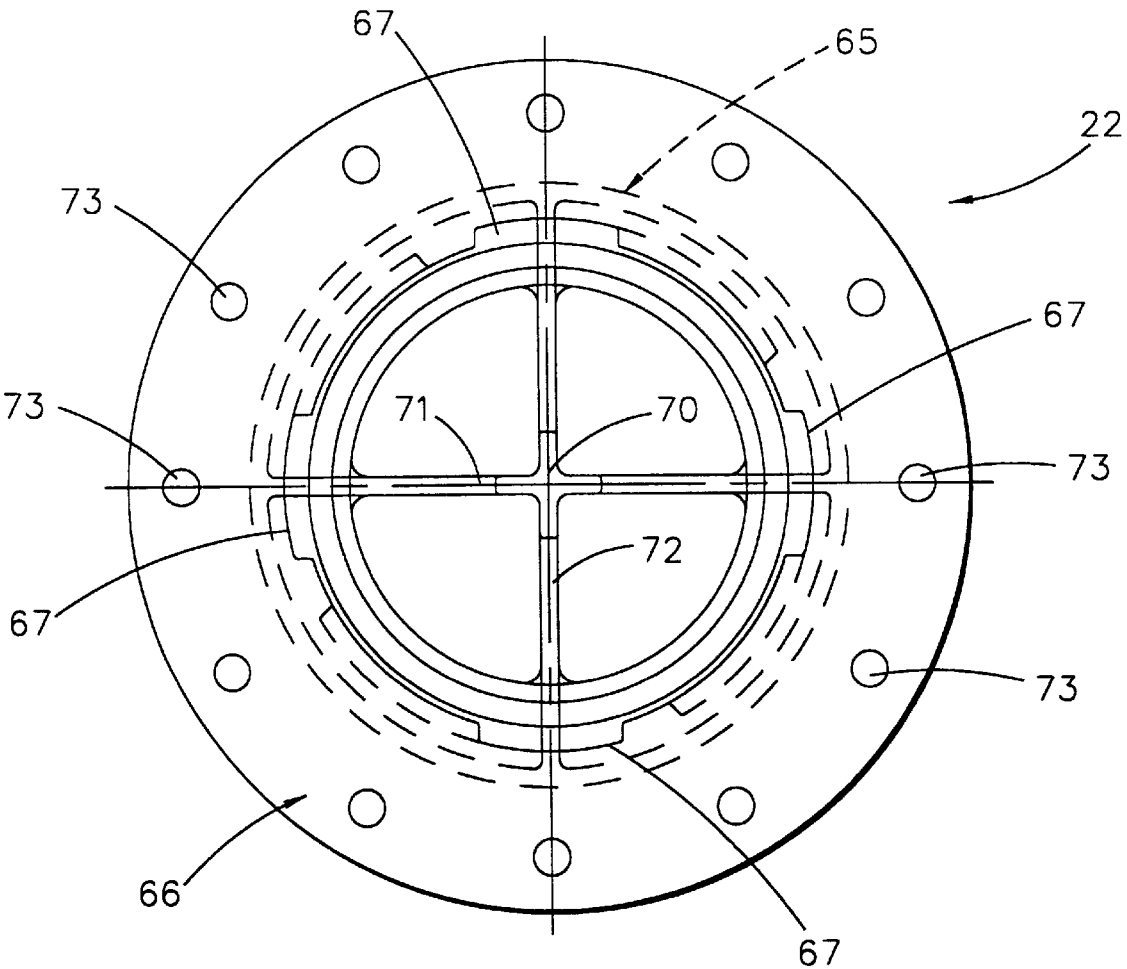
FIG. 6 is a top plan view of a tank adapter forming a second component of the distribution system of the present invention.
Figure 7:
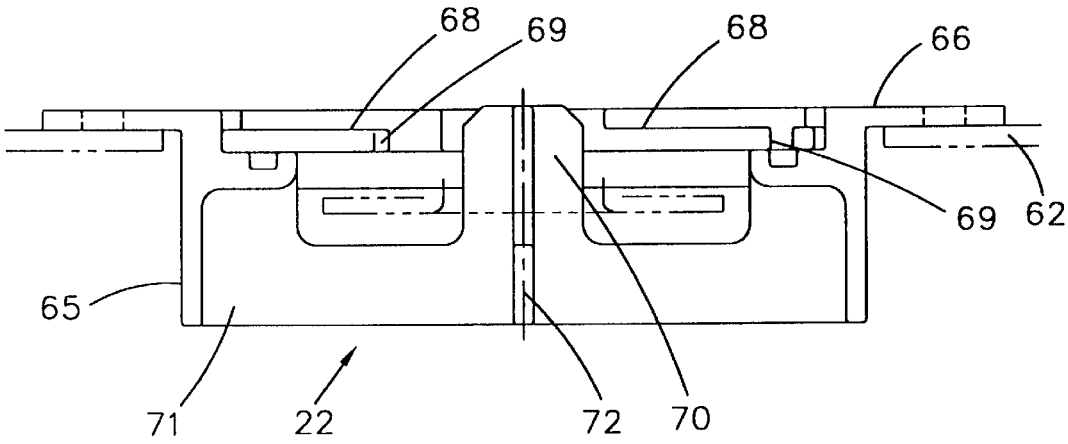
FIG. 7 is a cross-sectional side elevation view of the tank adapter of FIG. 6.
Figure 8:
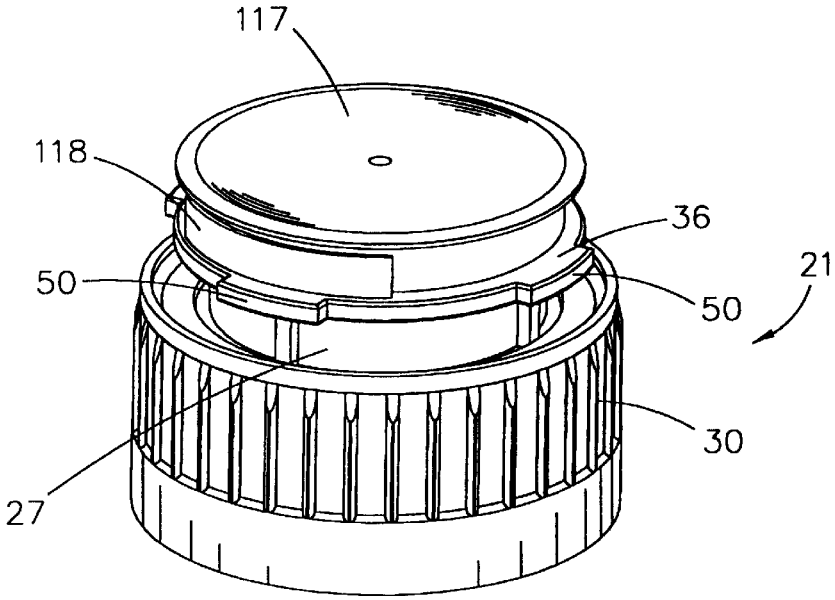
FIG. 8 is a perspective view depicting an alternate embodiment of the product dispensing valve assembly of the present invention shown in its closed and sealed position.
Figure 9:
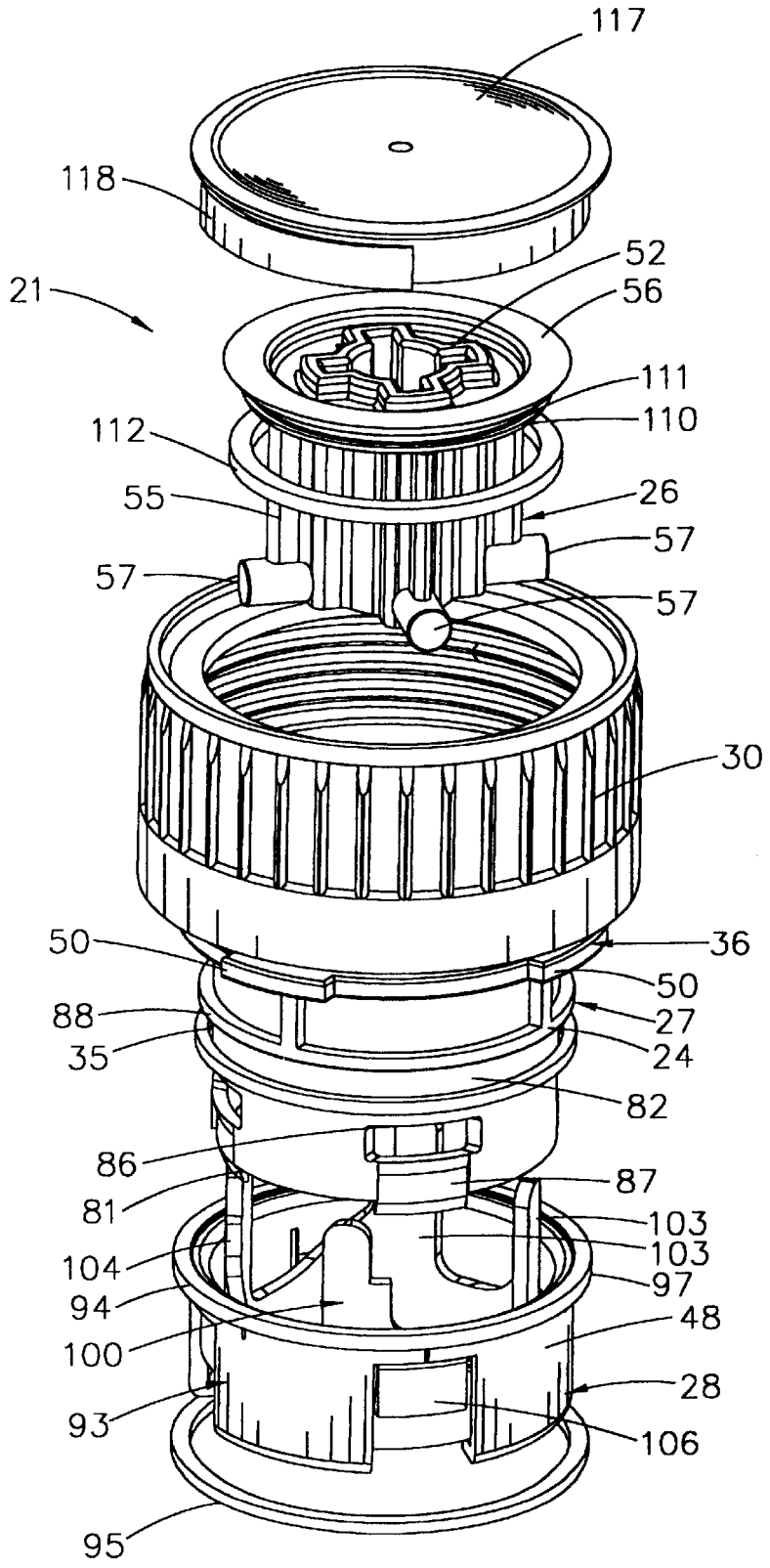
FIG. 9 is an exploded telescopic perspective view of the product dispensing valve assembly of FIG. 8 depicting the components forming this embodiment of the product dispensing valve assembly.

In order to provide assurance that the chemical product retained in container 60 is transferred into only specifically desired, authorized dilution tanks or vessels 62, a specially designed tank adapter 22 is mounted to each desired dilution tank or vessel 62. In FIGS. 6 and 7, one embodiment for tank adapter 22 of the present invention is depicted.

In this embodiment, tank adapter 22 comprises a base 65 having, in its preferred construction, a substantially open-ended hollow cylindrical shape. In addition, a flange 66 is mounted to one end of cylindrically shaped base 65, radially extending outwardly therefrom. In this construction, flange 66 incorporates a plurality of mounting holes 73 which are employed to securely affix tank adapter 22 to any desired dilution tank/vessel 62. If desired, alternate mounting means can be employed for quickly and easily securely mounting tank adapter 22 to any particular dilution tank/vessel 62 into which the desired chemical product is to be transferred.

At the interconnecting juncture between base 65 and flange 66, tank adapter 22 incorporates a plurality of notches 67 formed therein in a substantially circular, spaced array. Each notch 67 is specifically dimensioned for receiving one of the locking fins or tabs 50 radially extending from plate portion 36 of housing 27. As a result of this construction, product dispensing valve assembly 21 is capable of being matingly inserted into only specifically designed tank adapters 22 constructed for receiving and matingly co-operating with the radially extending locking fins 50 formed as part of product dispensing valve assembly 21.

Tank adapter 22 also incorporates a plurality of channels or recesses 68 formed in base 65 and co-operatively associated with notches 67. As shown in FIG. 7, each channel or recess 68 is constructed to be open at one end thereof with notch 67 while terminating at it opposed end with abutment stop 69.

By employing this construction, plate portion 36 of housing 27 of product dispensing valve assembly 21 is capable of being cooperatively inserted into tank adapter 21 by aligning locking fins 50 with notches 67. Once so aligned, further telescopic advancement of product dispensing valve assembly 21 with tank adapter 22 causes plate portion 36 to advance into further telescopic engagement with base 65 of tank adapter 20 to until locking fins or tabs 50 are aligned with channels or recesses 68. Once in this position, the arcuate pivoting movement of container 60 and/or product dispensing valve assembly 21 causes locking fins or tabs 50 to enter channels or recesses 68, until contact is made with abutment stops 69.

Once product dispensing valve assembly 21 is mounted in this position with tank adapter 22, valve assembly 21 is in secure, locked interengagement with tank adapter 22, in a manner which prevents direct telescopic disengagement of these components. Only by arcuately pivoting product dispensing valve assembly 21 relative to tank adapter 22 in a reverse direction is the removal of product dispensing valve assembly 21 from tank adapter 22 capable of being achieved.

In addition to providing secure, locked interengagement of product dispensing valve assembly 21 with tank adapter 22, tank adapter 22 is also constructed to simultaneously open product dispensing valve assembly 21 while product dispensing valve assembly 21 is lockingly engaged with tank adapter 22. In order to achieve the simultaneous activation or opening of product dispensing valve assembly 21, tank adapter 22 incorporates an upstanding activation pin 70, which is constructed with a configuration which enables pin 70 to enter receiving zone 52 formed in sealing disc 56 of valve member 26.

As discussed above, receiving zone 50 incorporates a unique configuration requiring a specially formed activation pin to be employed to enter receiving zone 52. In addition, the configuration used for activating pin 70 and receiving zone 52 is constructed to assure that arcuate pivoting forces acting upon activation pin 70 will cause valve member 26 to arcuately pivot relative to housing 27 of product dispensing valve assembly 21. A shown through the Figures, the particular configuration employed for this embodiment of the present invention comprises an "X"-shape or "T"-shape. However, any alternate configuration which will provide the same function can be employed.

In the embodiment depicted in FIGS. 6 and 7, activation pin 70 is formed with dimensions substantially equal to the size and shape of receiving zone 52 of valve member 26. In this embodiment, activation pin 70 is formed by two substantially identically shaped wall members constructed to intersect with each other substantially perpendicularly at their respective midpoints.

In order to position and maintain activation in 70 in the precisely desired location for entering receiving zone 50 of product dispensing valve assembly 21, while valve assembly 21 matingly engages with tank adapter 22, supporting rods or beams 71 and 72 are employed. In this construction, support rods/beams 71 and 72 are formed adjacent the open end of base 65, extending along perpendicular diameters thereof.

A plurality of alternate configurations or constructions can be employed for maintaining activation pin 70 in the precisely desired location for mating interengagement with receiving zone 52. In one alternate configuration, shown in FIGS. 14–18 and fully detailed below, a circular shape support base is mounted cooperatively associated with spring means for providing a floating platform on which activation pin 70 is mounted extending upwardly therefrom. In this way, axial displacement of the floating platform can be achieved for assuring secure, sealed, mounted engagement of product dispensing valve assembly 21 with tank adapter 22. In order to further enhance the sealed interengagement of the components, the floating platform may incorporate seal means formed on the surface thereof for contacting and sealing disk 56. In this way, assurance is provided that the transfer of the chemical directly into dilution tank/vessel 62 is achieved without having any chemical product being discharged into unwanted areas.

By employing the construction detailed above, the telescopic interengagement of product dispensing valve assembly 21 with tank adapter 22 causes activation pin 70 of tank adapter 22 to enter receiving zone 52 of valve member 26 while locking fins or tabs 50 telescopically engage within notches 67 of tank adapter 22. Once plate portion 36 of product dispensing valve assembly 21 is fully engaged with tank adapter 22, product dispensing valve assembly 21 is arcuately pivoted to cause locking fins or tabs 50 to enter channels or recesses 68 of tank adapter 22.

During this arcuate pivoting movement, housing 27 is able to arcuately move as part of product dispensing valve assembly 21, while valve member 26 is incapable of arcuate movement due to its secure interengagement with activation pin 70 through receiving zone 52. As a result, as fully detailed above, valve member 26 is forced to axially advance relative to housing 27 of product dispensing valve assembly 21, longitudinally moving from its closed and sealed position to its open position. In order to assure that valve member 26 is able to axially advance away from housing 27 and effectively open product dispensing valve assembly 21, activation pin 70 is constructed with a sufficient length to accommodate the longitudinal, axial movement of valve member 26 relative to housing 27.

As is evident from the foregoing detailed disclosure, product dispensing valve assembly 21 and tank adapter 22 combine to provide a unique distribution system 20 enabling any desired chemical product to be transferred from storage container 60 into a mixing or dilution tank/vessel 62 in a completely controlled manner, wherein only dilution tank/vessel 62 having the appropriate mating tank adapters 22 are capable of receiving the chemical product. Furthermore, by employing this construction, a completely controlled, spill-free transfer of all of the chemical product into the tank/vessel 62 is realized.

In FIGS. 8–28, an alternate embodiment of the controlled product distribution system 20 of the present invention is fully depicted. In these Figures, FIGS. 8–13 show an alternate construction for product dispensing valve assembly 21, while FIGS. 14–18 fully depict an alternate construction for tank adapter 22.

In addition, in order to provide a full, detailed disclosure of this embodiment of the present invention, FIGS. 19–23 are included for fully detailing the construction of housing 27, which forms a part of product dispensing valve assembly 21. Furthermore, FIGS. 24–28 are also included for providing a full detailed disclosure of cam track forming member 28, which is also employed in this embodiment of product dispensing valve assembly 21.

In order to assist in fully understanding the construction similarities between product dispensing valve assembly 21 and tank adapter 22 of this embodiment of the present invention as compared to product dispensing valve assembly 21 and tank adapter 22 of the embodiment detailed above and shown in FIGS. 1–7, similar reference numerals are employed in FIGS. 8–28 to refer to similar components or elements incorporated into this alternate embodiment. Although alternate constructions and alternate component assemblies are employed for producing these embodiments of product dispensing valve assembly 21 and tank adapter 22, the overall operation and cooperative engagement of product dispensing valve assembly 21 with tank adapter 22 in order to attain controlled distribution system 20 is substantially identical to the operation detailed above in reference to the first embodiment, shown in FIGS. 1–7.

By referring to FIGS. 8–13, along with the following detailed discussion, the construction and operation of one preferred alternate embodiment of product dispensing valve assembly 21 is fully disclosed. In addition, reference should also been made to FIGS. 19–23 for a detailed understanding of the construction of the alternate embodiment for housing 27, as well as FIGS. 24–28 for a detailed understanding of the construction of the alternate embodiment for cam track forming insert 28, both of which form components of valve assembly 21.

In this alternate embodiment for product dispensing valve assembly 21, valve member 26 is mounted in axially movable and arcuately pivotal engagement with housing 27, in captured, cooperating engagement with cam track forming insert 28 and the cam tracks formed thereby. In this embodiment, product dispensing valve assembly 21 is completed by incorporating threaded retaining ring or collar 30 mounted in cooperating, engaged relationship with housing 27 and cam track forming insert 28, in locked engagement therewith to prevent removal of each component from the other.

As shown throughout the cited Figures, housing 27 comprises a hollow, generally cylindrically shaped tube portion 35 incorporating opposed terminating edges 80 and 81, inner wall 40 and outer wall 82. In this embodiment, radially extending, substantially flat plate or ledge portion 36 is mounted to outer wall 82, spaced below terminating edge 80. Preferably, radially extending, substantially flat plate/ledge portion 36 comprises a diameter substantially less than the diameter employed for plate portion 36 in the previous embodiment detailed above. However, in this embodiment, a plurality of locking fins or tabs 50 are formed about the circular terminating edge of plate/ledge portion 36, radially extending therefrom for cooperating with tank adapter 22, as detailed below.

As clearly shown in FIGS. 19–23, inner wall 40 of tube portion 35 incorporates a plurality of cam surface defining elements 41 in the form of raised panels, radially extending from the surface of inner wall 40. In the preferred embodiment, four separate and independent cam surface defining elements 41 are formed about inner wall 40 of tube portion 35, with each cam surface defining element 41 being equally spaced from each other and positioned in juxtaposed, spaced adjacent, side-to-side relationship to each other. In addition, the arcuate width of each cam surface defining element 41 comprises less than 25% of the circumference of inner wall 40, thereby establishing a construction wherein a spaced zone 85 is formed between each adjacent cam surface defining element 41.

In this embodiment of the present invention, each cam surface defining element 41 incorporates cam track or ledge 42 formed as the lower portion of cam surface defining element 41. In the preferred construction, each cam track/ledge 42 comprises three separate and distinct zones or portions, a substantially flat portion 83 formed at one end, a ramped, sloping, elongated central portion 84, and a short, flat end portion 89 forming the opposed end.

Preferably, substantially flat portion 83 is constructed to resist the movement of valve member 26 thereon. Consequently, ease of manual opening is avoided and only authorized, specially constructed mating adapters are able to be used to open valve 26. The desired resistance is achieved by such means as proper sloping of portion 83 or incorporating a small ledge or raised area.

As detailed below, in this embodiment of the present invention, cam track forming insert 28 is constructed for cooperating, aligned interengagement with cam track/ledge portion 42 of housing 27 for establishing four separate and independent cam tracks 45 within which valve member 26 is controllably moved. In this way, the precisely desired arcuate pivoting and longitudinally movement of valve member 26 relative to housing 27 and insert 28 is achieved.

In this construction of housing 27, tube portion 35 also incorporates substantially circular shaped ring 88, radially extending from outer surface 82 of tube portion 35. In the preferred embodiment, substantially circular shaped ring 88 is positioned below plate/ledge portion 36 and comprises a diameter substantially less than the diameter of portion 36. As detailed below, ring 88 forms an abutment stop for positioning cam track forming insert 28 in the desired location on housing 27.

The construction of tube portion 35 of housing 27 is completed by incorporating a plurality of apertures 86 in tube portion 35, positioned in juxtaposed spaced relationship with each other, and equally spaced about the circumference of tube portion 35. In addition, each aperture 86 extends through outer wall 82 and inner wall 40, forming a substantially rectangular shaped opening. In the preferred construction, four separate and independent apertures 86 are formed in tube portion 35.

The final principal element incorporated in tube portion 35 of housing 27 comprises beveled or tapered tabs 87 formed on terminating end 81 of tube portion 35. Preferably, four separate tabs 87 are employed with each tapered/beveled tab 87 being aligned with each aperture 86. Preferably, each tab 87 is positioned directly below and aligned with one of the four apertures 86 formed in tube portion 35, forming a guiding surface to each aperture 86.

As discussed above, cam tracks 45 are formed by securely affixing cam track forming member 28 to housing 27. In order to attain this result, cam track forming member 28 is telescopically advanced into cooperating locked interengagement with housing 27, forming cam tracks 45 and securely capturing valve 26 in axial movable and arcuately pivotable cooperation therewith.

In order to attain this secure, locked interenigagemenit, while simultaneously forming cam tracks 45, cam track forming member 28 comprises, in this embodiment and as shown in FIGS. 24–28, a generally cylindrical shaped member 93, having outer wall 48, a first terminating end 94, and an opposed terminating end or base 95. In addition, cam track forming member 28 incorporates flange 97 mounted to terminating end 94 and radially extending outwardly therefrom.

In addition, cam track forming member 28 incorporates insert member 100, which comprises a substantially continuous base portion 101, having a generally cylindrical shape and positioned inside inner wall 96 of cylindrically shape member 93, in juxtaposed, spaced, facing relationship therewith. In the preferred construction, base portion 101 is interconnected to cylindrical member 93 at terminating end 95 by interconnecting plate 102. In this way, the precise position and aligned relationship of insert member 100 relative to cylindrically shaped member 93 is assured.

In the preferred construction, insert member 100 comprises a plurality of elongated, upstanding finger members 103 positioned in spaced relationship to each other, extending upwardly from base portion 101. In addition, a sloping, slanted cam surface 104 is formed along the edge of insert member 100, generally extending from one finger member 103 to the adjacent finger member 103. In the preferred construction, four separate and independent upstanding finger members 103 are formed as part of insert member 100, with each finger member 103 being spaced apart an equal distance from each other.

In addition, four separate and independent sloping, slanted, cam track forming surfaces 104 are formed along insert member 100, with each cam surface 104 having substantially equal dimensions and being positioned between adjacent upstanding finger members 103. Finally, the construction of insert member 100 is completed by incorporating four separate and independent abutment surfaces 105, each positioned directly adjacent one side of each upstanding finger member 103, extending therefrom to the terminating edge of each cam surface 104.

In order to complete the preferred construction for this embodiment of cam track forming member 28, cylindrically shaped member 93 incorporates a plurality of flexible locking fins 106 formed therein. In the preferred embodiment, four separate and independent locking fins 106 are formed in cylindrically shaped member 93, positioned about the outer wall 48, substantially equally spaced from each other. In addition, in the preferred construction, a cut-out zone peripherally surrounds each locking fin 106 to assure the independent, flexible movement thereof in order to provide cooperative locking engagement of each fin 106 with one aperture 86 of housing 27.

In order to achieve the desired formation of each cam track 45, cam track forming member 28 is co-axially aligned and telescopically advanced into secure, locked engagement with tube portion 35 of housing 27. As fully detailed below, in order to attain the desired secure, locked interengagement, upstanding finger members 103 are inserted into tube portion 35 of housing 27, with flexible locking fins 106 aligned with apertures 86 of tube portion 35. In the preferred construction of this embodiment of the present invention, the spaced distance between insert member 100 and inside wall 96 of cylindrically shaped member 93 of cam track forming member 28 is substantially equivalent to or slightly greater than the thickness of tube portion 35 of housing 27. In this way, tube portion 35 is telescopically insertable between cylindrically shaped member 93 and insert member 100.

When these components are aligned in this desired manner, beveled/tapered tabs 87 are axially aligned with flexible locking fins 106 of cam track forming insert 28. By employing this construction, each beveled/tapered tab 87 is brought into sliding, frictional, overriding engagement with one flexible locking fin 106, causing each locking fin 106 to be controllably flexed outwardly against the forces tending to maintain ins 106 in their original position. This cooperating, sliding, contacting, controlled engagement continues until each flexible locking fin 106 has advanced into alignment with one aperture 86, at this time, each locking fin 106 returns to its original unflexed position, causing each locking fin to be brought into secure, locked, interengagement within one aperture 86. Once in this position, cam track forming insert 28 and housing 27 are securely affixed to each other in locked engagement, incapable of being separated, without employing extraordinary efforts.

In addition, cam surface defining elements 41 and spaced zones 85 of housing 27 are constructed, as detailed above, in a manner which enables each upstanding finger member 103 of insert member 100 to be advanced into one spaced zone 85 simultaneously with the interlocking, mounted engagement of cam track forming insert 28 with housing 27. In addition, each sloping, slanted cam surface 104 is advanced into juxtaposed, spaced, cooperating relationship with one cam track/ledge 42 of each cam surface defining element 41, while each abutment surface 105 is brought into contact with an end portion 89 of cam track defining element 41. By employing this construction, each cam track/ledge portion 42 is aligned in juxtaposed, spaced, cooperating relationship with a sloping, slanted cam surface 104 of insert member 100, forming the desired cam track 45 for controlling the desired longitudinal and arcuate movement of valve member 26 therein.

In order to control the axial engagement of cam track forming insert 28 with housing 27, radially extending flange 97 is positioned for contacting, abutting engagement with radially extending ring 88 of tube portion 35. By employing these components, along with abutment surfaces 105, the precisely desired co-axial engagement of housing 27 and insert member 28 is assured. In addition, as more fully detailed below, radially extending flange 97 also cooperates with plate portion 36 to capture and securely retain ring or collar 30 to housing 27 and insert member 28 when fully assembled.

As best seen in FIGS. 9–13, in the preferred construction of this alternate embodiment of product dispensing valve assembly 21, valve member 26 comprises a central section 55, a sealing disc 56 mounted to one end of central section 55, and a plurality of radially extending fingers 57 mounted to the opposed end of central section 55. In this construction, radially extending fingers 57 are constructed for being retained in cam tracks 45 formed by housing 27 and insert member 28 in order to control the movement of valve member 26 relative to housing 27/insert member 28.

The diameter of sealing disc 56 of valve member 26 is constructed for cooperative sealing engagement with terminating edge 80 of housing 27. If desired, edge 80 may be beveled or chamfered in order to enhance the sealing engagement of edge 80 with disc 56. In this regard, in the preferred construction, valve member 26 incorporates a radially extending flange 110 positioned in juxtaposed, spaced relationship with disc 56 to form retaining zone 111 therebetween. In addition, retaining zone 111 is constructed for enabling an O-ring 112 to be secured therein. By employing this construction, and forming terminating end 80 of housing 27 to cooperate therewith, the desired sealed, contacted engagement of disc 56 with end 80 of housing 27 is assured.

In addition, when valve 26 is in the closed position, the contents of any container to which valve assembly 21 is mounted is incapable of being dispensed from the container, until valve member 26 has been moved out of sealed engagement with housing 27 for allowing the contents in the container to flow or move past central section 55 and sealing disc 56.

Figure 10:
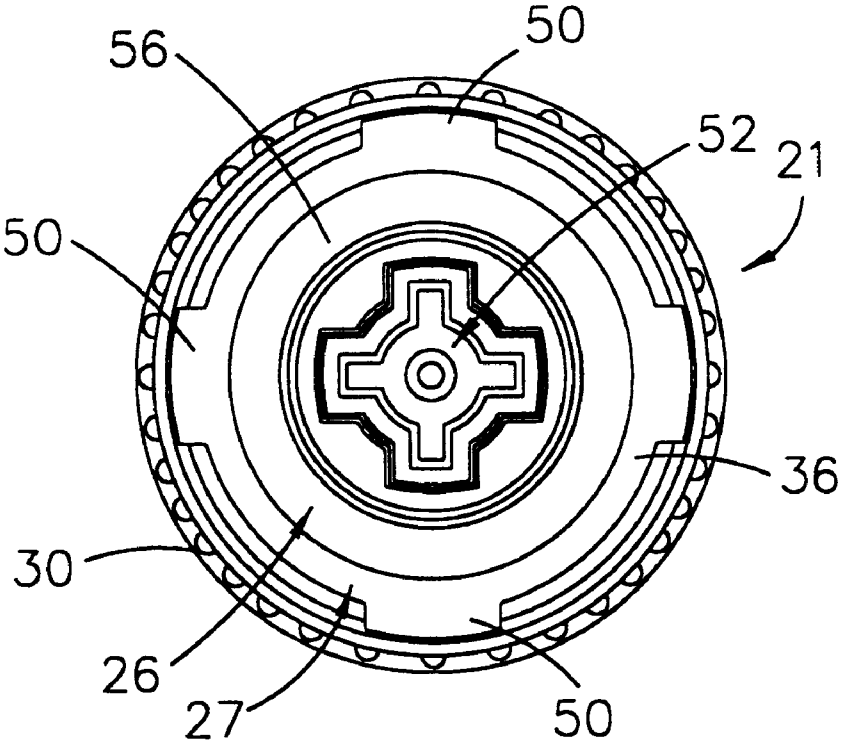
FIG. 10 is a top plan view of the product dispensing valve assembly of FIG. 8, depicted with the tamper evident cap removed therefrom.

In order to enable valve member 26 to be controllably movable relative to housing 27/insert member 28 whenever desired by an authorized user, valve member 26 incorporates activating in receiving zone 52. As best seen in FIG. 10, activating pin receiving zone 52 comprises, in this preferred configuration, a generally "X"-shaped or "T"-shaped zone formed in disc 56 or the top surface of central section 55 and extending from its top surface into central section 55.

As discussed above, any desired shape or configuration can be employed for activating pin receiving zone 52. The principal requirement for pin receiving zone 52 is a configuration which requires a specially designed mating component or pin to be employed in sufficient force receiving contact areas between the pin member and pin receiving zone 52 to cause valve member 26 to pivot relative to housing 27/insert member 28.

As shown in FIGS. 10–13, pin receiving zone 52 is formed by incorporating a plurality of partitions or walls as part of central section 55 of valve member 26. However, any alternate construction or alternate shape, as discussed above, can be employed with equal efficacy.

By employing the overall construction detailed above, a highly effective, easily used product dispensing valve assembly 21 is realized which is capable of providing secure, sealed retention of the chemical products in a container when desired, as well as enabling the chemical product to be easily dispensed from the storage container into a mixing or receiving vessel. As is fully detailed below, in reference to tank adapter 22, the desired controlled activation of valve assembly 21 is realized only when specifically constructed, authorized equipment is employed.

Figure 11:
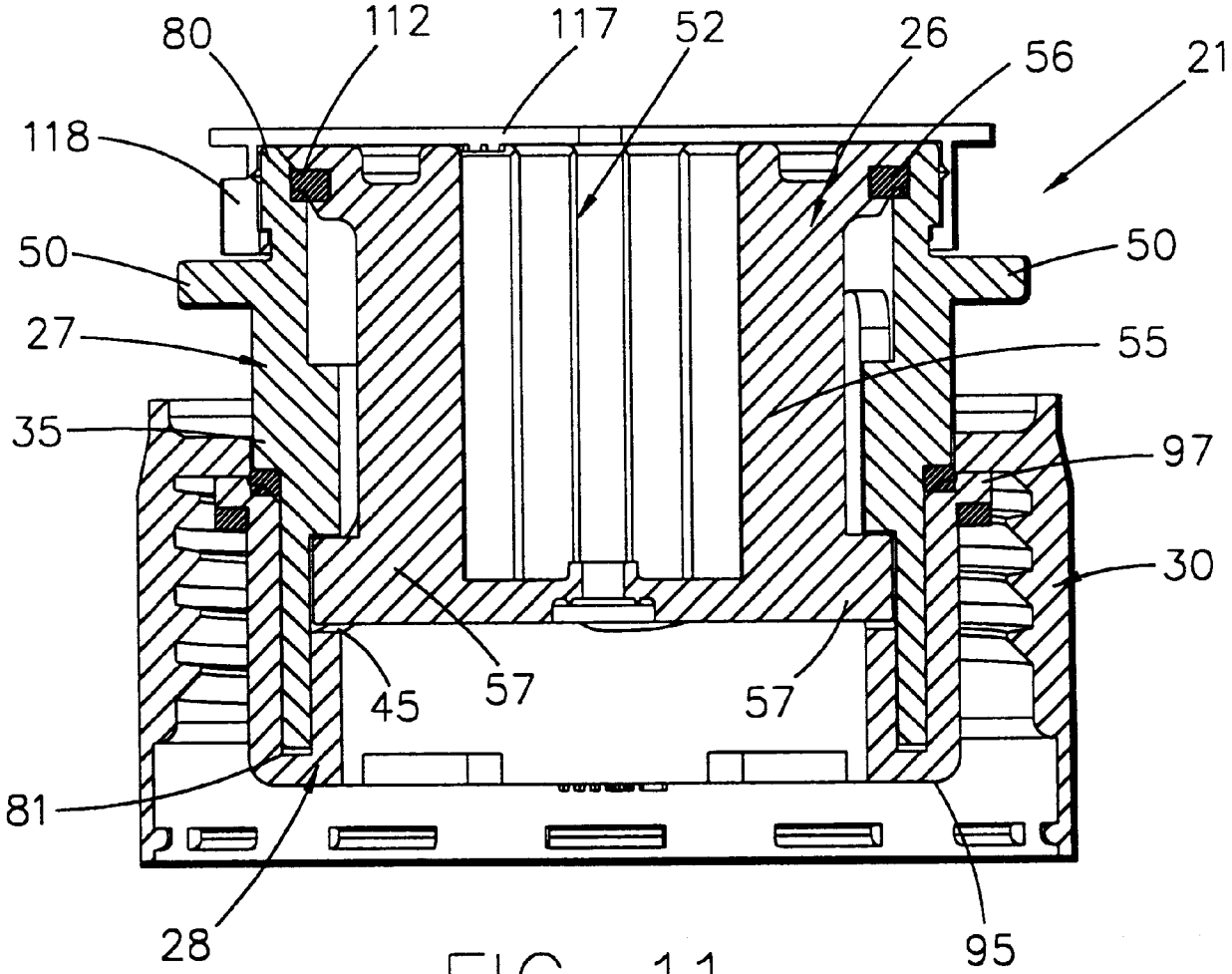
FIG. 11 is a cross-sectional side elevation view, substantially enlarged, showing the product dispensing valve assembly of FIG. 10.
Figure 12:
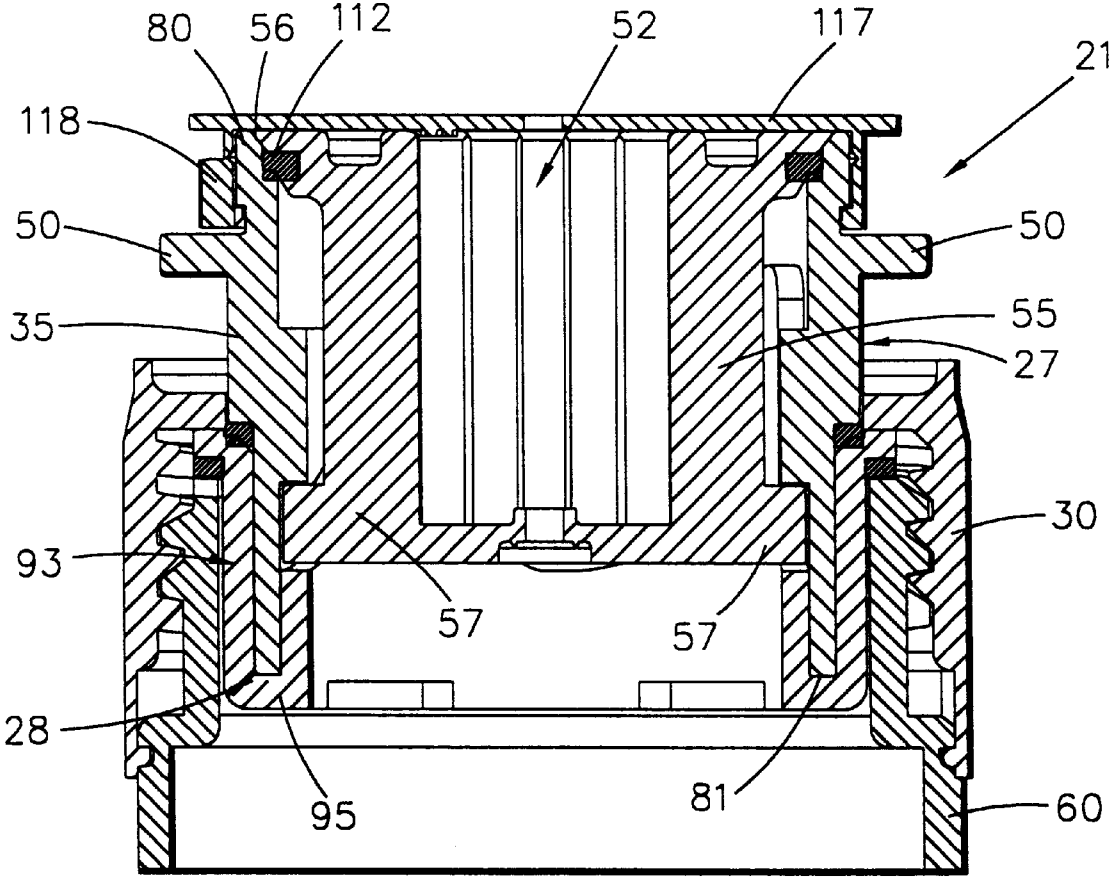
FIG. 12 is a cross-sectional side elevation view of the product dispensing valve assembly of FIG. 8 depicted mounted to a container and in its normally closed position.

In FIGS. 11 and 12, product dispensing valve assembly 21 is depicted in the closed, sealed position, with FIG. 12 depicting product dispensing valve assembly 21 mounted to a conventional container 60 within which the desired chemical product is retained. As is evident from the foregoing discussion and the associated Figures, the product retained in container 60 is able to exit from container 60 by passing between the outer surface of central section 55 of valve member 26 and the inside wall 40 of tube portion 35 of housing 27. However, when valve member 26 is in the closed, sealed position, the terminating edge of sealing disk 56 is in direct contact with terminating end 80 of housing 27. When in this position, product dispensing valve assembly 21 is effectively closed and the chemical product retained in container 60 is incapable of exiting therefrom.

As previously discussed, the overall construction of product dispensing valve assembly 21 is completed by mounting threaded sealing ring/collar 30 to housing 27 and insert member 28. In the preferred construction, threaded sealing ring/collar 30 is first mounted about tube portion 35 of housing 27, peripherally surrounding lower outer wall 82 thereof. In addition, ring/collar 30 incorporates a flange 115 radially extending inwardly and comprising an inside diameter greater than the diameter of outer wall 82. In this way, sealing ring/collar 30 is axially movable along outer wall 39 of tube portion 35 in order to provide ease of attachment of product dispensing valve assembly 21 to any desired container.

In addition, in order to assure that sealing ring/collar 30 is incapable of being removed from housing 27 or insert member 28, flange 115 of ring/collar 30 is positioned between and axially captured by plate portion 36 of housing 27 and flange 97 of insert member 28. Each of these components are constructed with a diameter which prevents flange 115 from moving beyond plate portion 36 or flange 97. As a result, ring/collar 30 is able to move axially along tube portion 35, between plate portion 36 and flange 97.

In order to activate or open product dispensing valve assembly 21, valve member 26 must be moved relative to housing 27 in a manner which causes sealing disk 56 to be moved out of sealing engagement with terminating end 80 of housing 27. In the preferred construction of this embodiment, the desired movement of valve member 26 is achieved by simultaneously moving valve member 26 arcuately and longitudinally.

As fully detailed above, radially extending fingers 57 of valve member 26 are mounted in cam tracks 45 of housing 27/insert member 28, thereby controlling the movement of valve member 26 relative to housing 27/insert member 28 to the path defined by cam tracks 45. As a result, valve member 26 is incapable of only axial movement relative to housing 27/insert member 28 and any movement of valve member 26 also requires simultaneous arcuate pivoting and longitudinal, axial movement of valve member 26 relative to housing 27/insert member 28. This movement is defined by and controlled by the movement of radially extending fingers 57, as finger 57 move along cam tracks 45.

Figure 13:
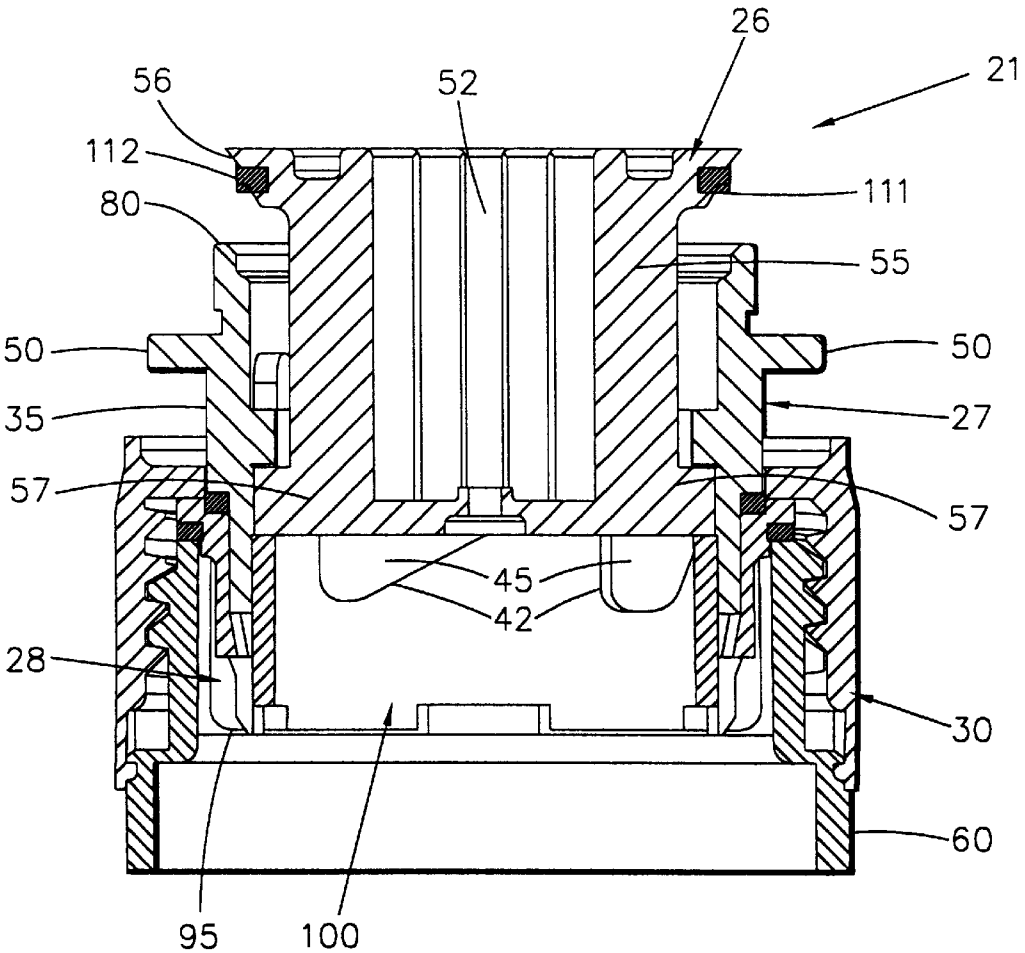
FIG. 13 is a cross-sectional side elevation view of the product dispensing valve assembly of FIG. 12 shown in its open position.
Figure 14:
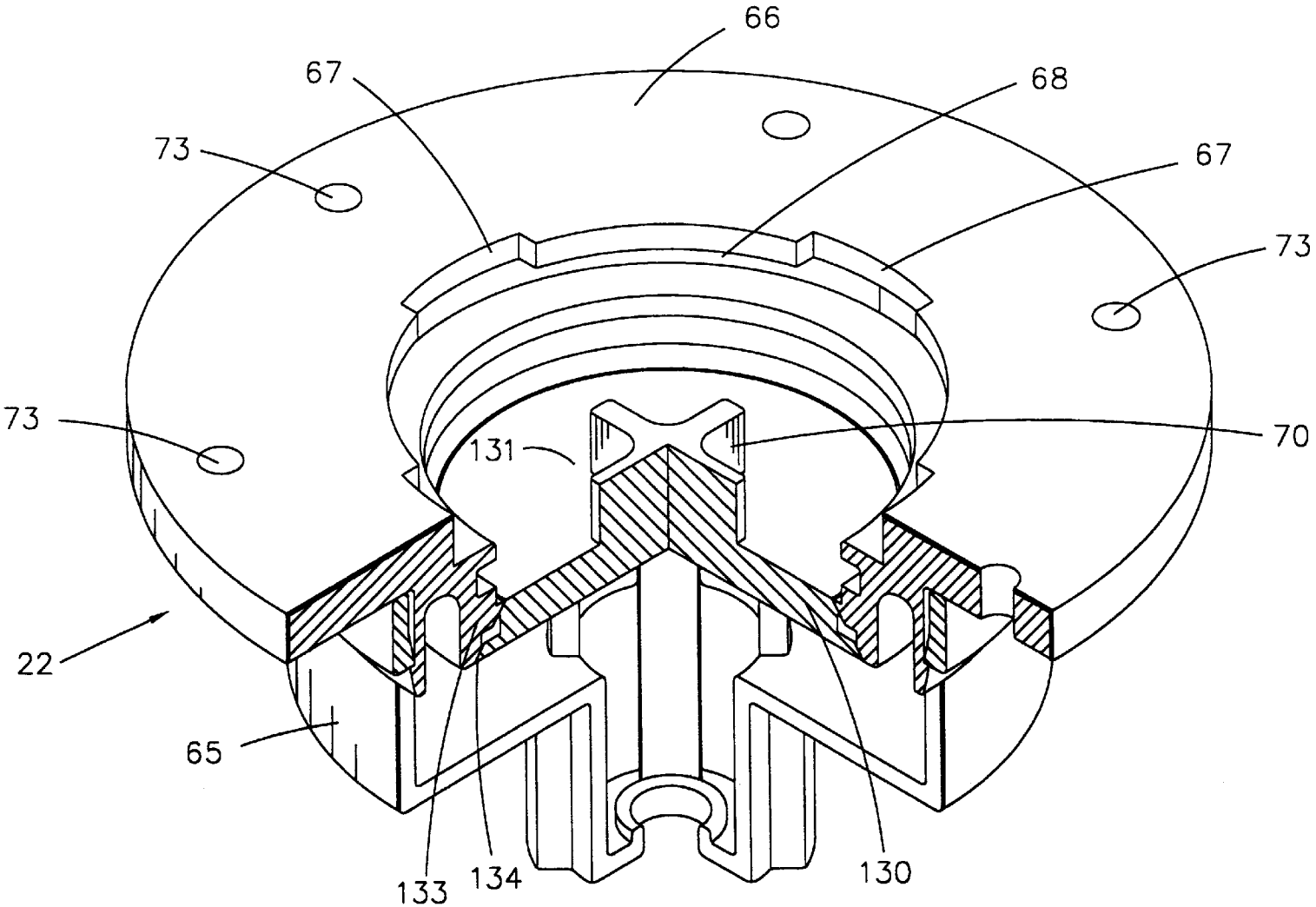
FIG. 14 is a perspective view, partially in cross-section, of an alternate embodiment for the tank adapter of the present invention.

As best seen in FIG. 13, the terminating ends of each radially extending finger 57 of valve member 26 are securely mounted in a cam track 45 formed as part of housing 27 and insert member 28. As a result, the movement of valve member 26 relative to housing/insert member 28 is controlled by the path defined by cam tracks 45.

As is more fully detailed below in regard to the cooperative engagement of product dispensing valve assembly 21 with tank adapter 22, the activation and movement of valve member 26 initially comprises an arcuate pivoting movement, causing each radially extending finger 57 to arcuately move in the substantially horizontal portion 83 of cam track 45 of housing 27. Once this arcuate movement has been achieved, any further arcuate pivoting motion of valve member 26 causes valve member 26 to simultaneously move longitudinally, along its central axis and the central axis of housing 27. This simultaneous arcuate pivoting motion and longitudinal, axial movement is defined by and controlled by the pathway established by cam track 45. Any such movement continues until radially extending fingers 57 have reached the terminating end of cam track 45.

When in this final, terminating position, sealing 56 of valve member 26 is longitudinally displaced forward of terminating end 80 of housing 27, establishing a substantial gap therebetween. When in this position, product dispensing valve assembly 21 is open and any chemical product stored in container 60 is capable of being transferred to the associated tank on which the authorized, cooperating tank adapter 21 is mounted. In this way, the desired controlled, spill-free transfer of the chemical product retained in storage container 60 to the dilution vessel or tank is achieved with assurance that only authorized transfer of the chemical product will occur.

If desired, product dispensing valve assembly 21 may comprise a sealing cap 117, which is constructed as a tamper-evident cap, enabling any individual to immediately know when the cap has been opened for the first time. In the embodiment depicted in FIGS. 8, 9, 11, and 12, sealing cap 117 is mounted to end 80 of housing 27 in a manner which prevents its removal until side strip 118 has been removed. Once side strip 118 is separated from cap 117, cap 117 can be lifted off of housing 27. However, the fact that cap 117 has been opened in this manner is immediately evident to any observer.

In order to provide assurance that the chemical product retained in container 60 is transferred into only specifically desired, authorized dilution tanks or vessels, a specially designed tank adapter 22 is mounted to each desired dilution tank or vessel. In FIGS. 14–18, an alternate preferred embodiment for tank adapter 22 of the present invention is depicted.

In this embodiment, tank adapter 22 comprises a base 65 having, in its preferred construction, a substantially hollow cylindrical shape, which is open on one end and partially closed on the opposed end. In addition, a flange 66 is mounted to the open end of cylindrically shaped base 65, radially extending outwardly therefrom. In this construction, flange 66 incorporates a plurality of mounting holes 73 which are employed to securely affix tank adapter 22 to any desired dilution tank/vessel. If desired, alternate mounting means can be employed for quickly and easily securely mounting tank adapter 22 to any particular dilution tank/vessel into which the desired chemical product is to be transferred.

At the interconnecting juncture between base 65 and flange 66, tank adapter 22 incorporates a plurality of notches 67 formed therein in a substantially circular, spaced array. Each notch 67 is specifically dimensioned for receiving one of the locking fins or tabs 50 radially extending from plate portion 36 of housing 27. As a result of this construction, product dispensing valve assembly 21 is capable of being matingly inserted into only specifically designed tank adapters 22 constructed for receiving and matingly co-operating with the radially extending locking fins 50 formed as part of product dispensing valve assembly 21.

Figure 18:
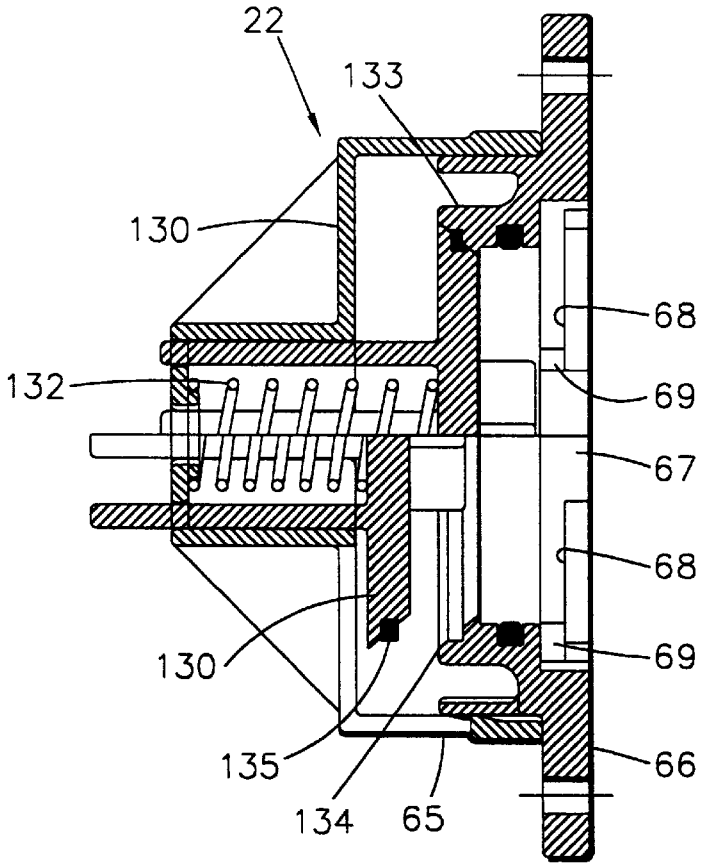
FIG. 18 is a cross-sectional side elevation view of the tank adapter of FIG. 14 showing the axial movable sealing plate thereof in its two alternate positions.
Figure 17:
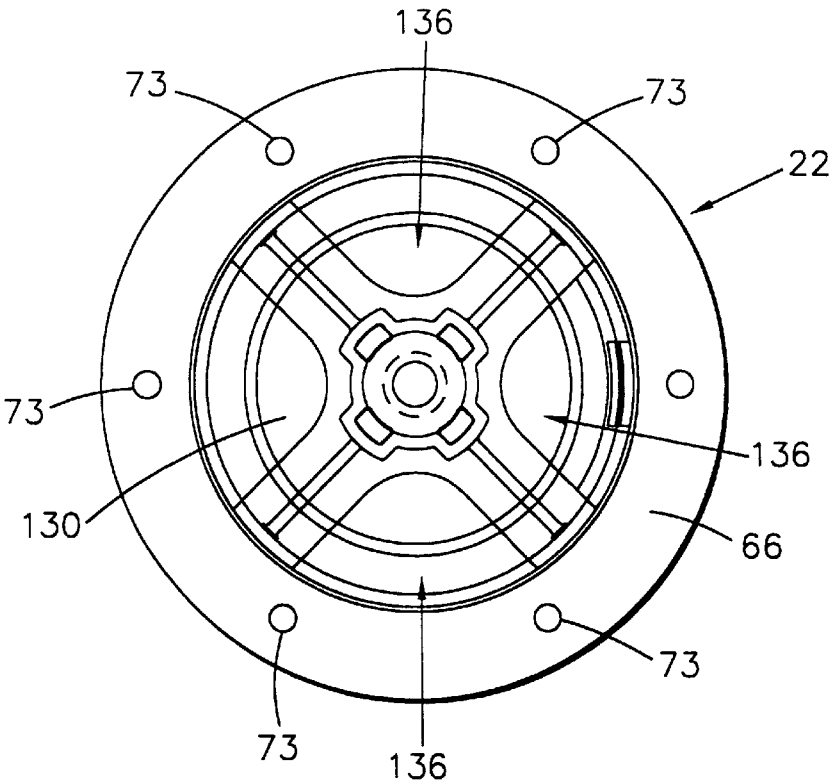
FIG. 17 is a bottom view of the tank adapter of FIG. 14.
Figure 19:
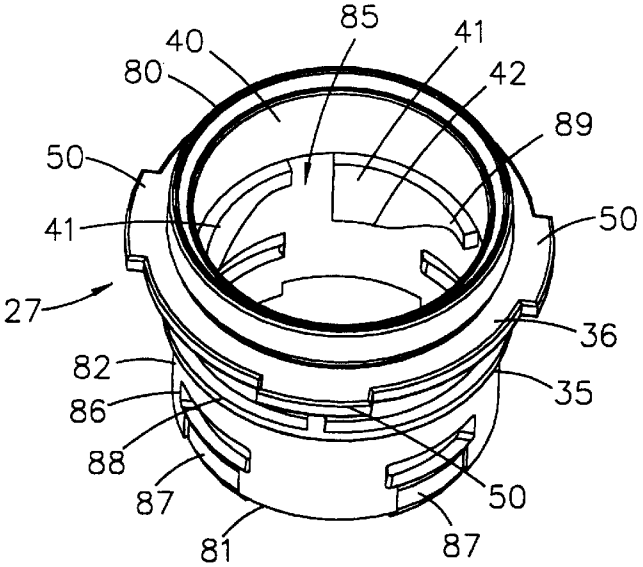
FIG. 19 is a perspective view of the housing which forms one component of the product dispensing valve assembly of FIG. 8.
Figure 21:
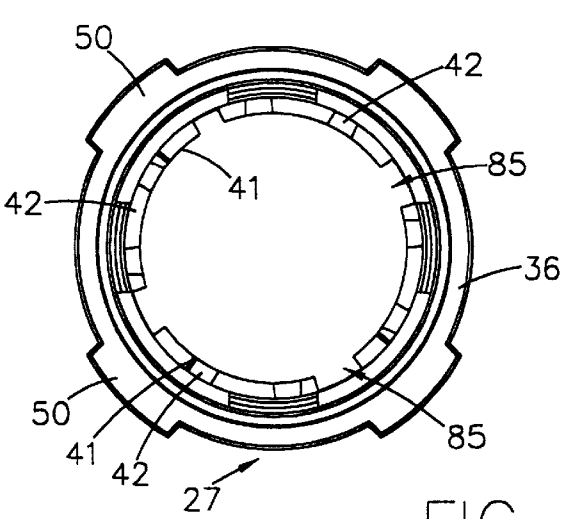
FIG. 21 is a bottom plan view of the housing of FIG. 19.
Figure 20:
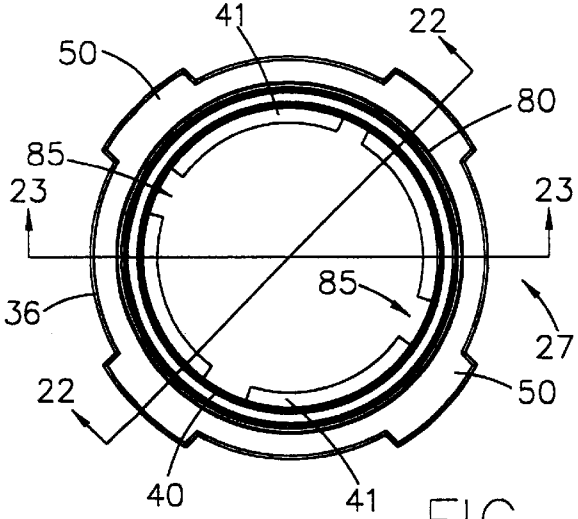
FIG. 20 is a top plan view of the housing of FIG. 19.
Figure 23:
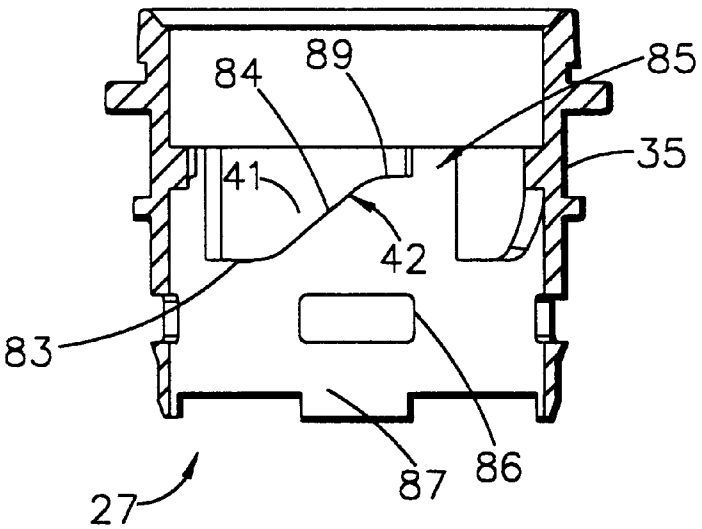
FIG. 23 is a cross-sectional side elevation view taken along line 23—23 of FIG. 20.
Figure 22:
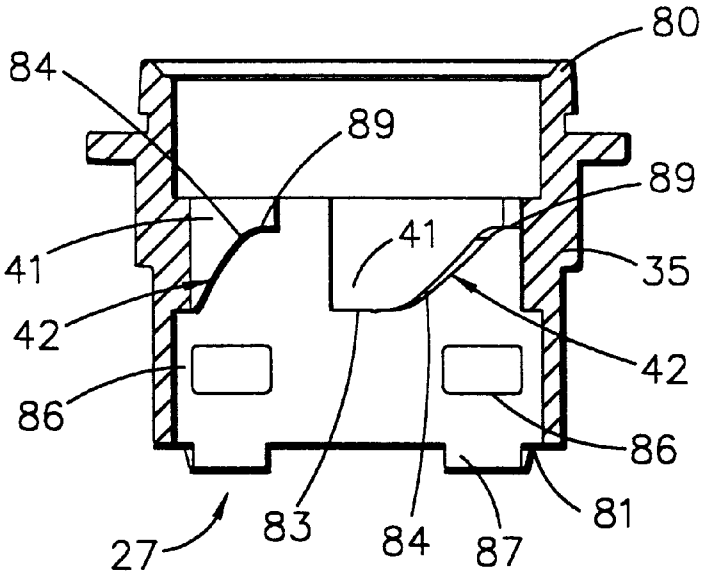
FIG. 22 is a cross-sectional side elevation view taken along line 22—22 of FIG. 20.
Figure 24:
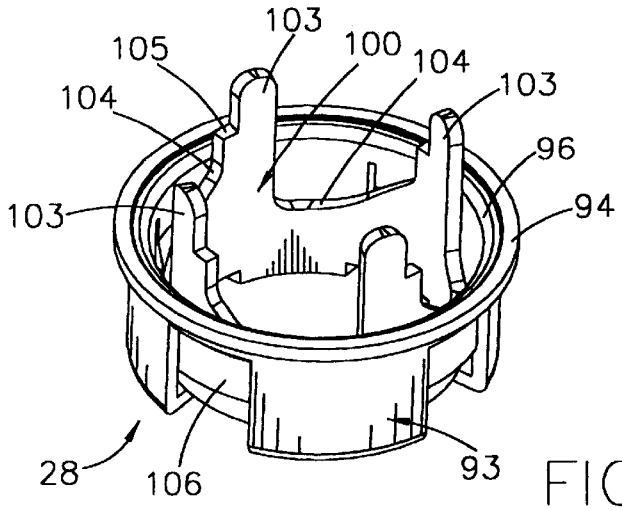
FIG. 24 is a perspective view of the cam track forming member which forms a component of the product dispensing valve assembly of FIG. 8.
Figure 25:
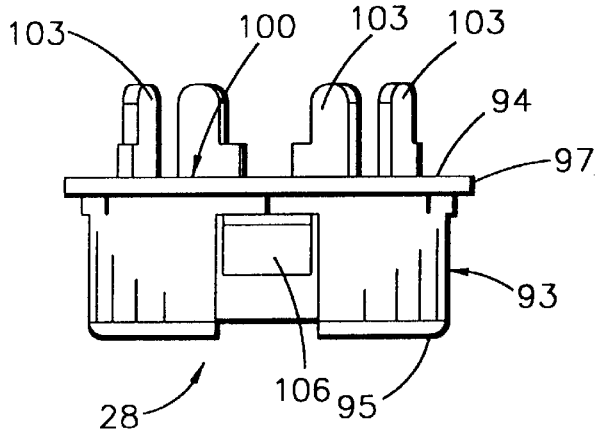
FIG. 25 is a side elevation view of the cam track forming member of FIG. 24.
Figure 26:
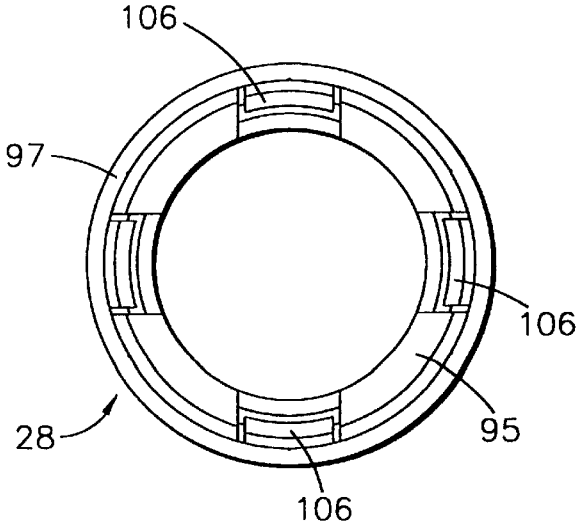
FIG. 26 is a bottom plan view of the cam track forming member of FIG. 24.
Figure 28:
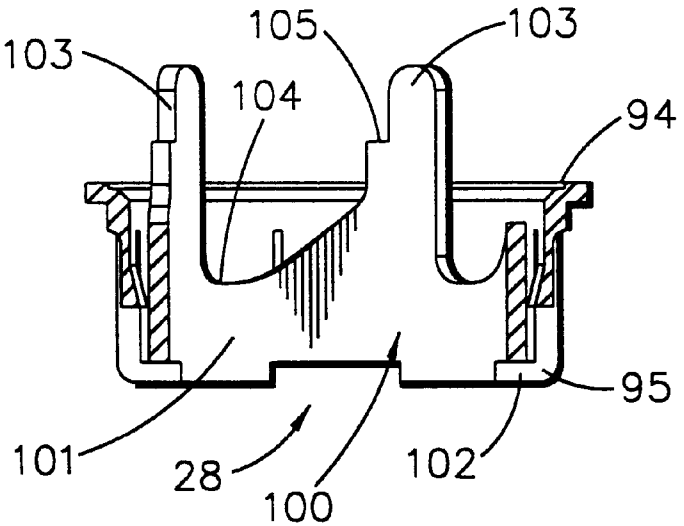
FIG. 28 is a cross-sectional side elevation view taken along line 28—28 of FIG. 26.
Figure 27:
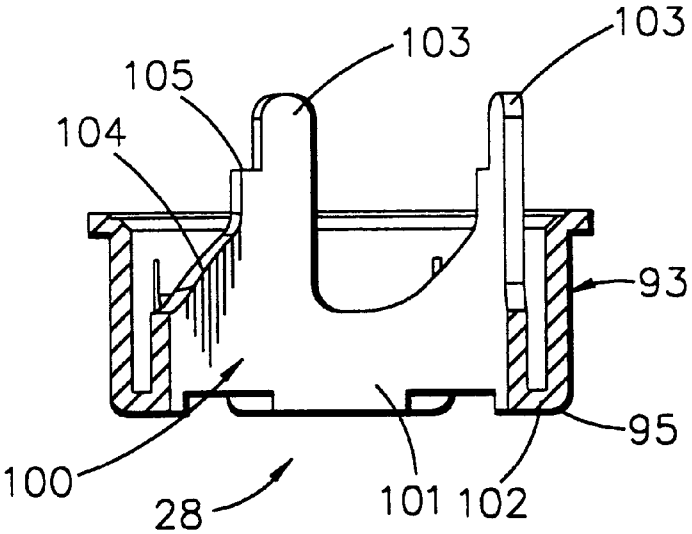
FIG. 27 is a cross-sectional side elevation view taken along line 27—27 of FIG. 26.

Tank adapter 22 also incorporates a plurality of channels or recesses 68 formed in base 65 and co-operatively associated with notches 67. As best seen in FIG. 18, each channel or recess 68 is constructed to be open at one end thereof with notch 67 while terminating at it opposed end with abutment stop 69.

By employing this construction, plate portion 36 of housing 27 of product dispensing valve assembly 21 is capable of being cooperatively inserted into tank adapter 21 by aligning locking fins 50 with notches 67. Once so aligned, further telescopic advancement of product dispensing valve assembly 21 with tank adapter 22 causes plate portion 36 to advance into further telescopic engagement with base 65 of tank adapter 22 until locking fins or tabs 50 are aligned with channels or recesses 68. Once in this position, the arcuate pivoting movement of container 60 and/or product dispensing valve assembly 21 causes locking fins or tabs 50 to enter channels or recesses 68, until contact is made with abutment stops 69.

Once product dispensing valve assembly 21 is mounted in this position with tank adapter 22, valve assembly 21 is in secure, locked interengagement with tank adapter 22, in a manner which prevents direct telescopic disengagement of these components. Only by arcuately pivoting product dispensing valve assembly 21 relative to tank adapter 22 in a reverse direction is the removal of product dispensing valve assembly 21 from tank adapter 22 capable of being achieved.

In addition to providing secure, locked interengagement of product dispensing valve assembly 21 with tank adapter 22, tank adapter 22 is also constructed to simultaneously open product dispensing valve assembly 21 while product dispensing valve assembly 21 is lockingly engaged with tank adapter 22. In order to achieve the simultaneous activation or opening of product dispensing valve assembly 21, tank adapter 22 incorporates an upstanding activation pin 70, which is constructed with a configuration which enables pin 70 to enter receiving zone 52 formed in sealing disc 56 of valve member 26.

As discussed above, receiving zone 50 incorporates a unique configuration requiring a specially formed activation pin to be employed to enter receiving zone 52. In addition, the configuration used for activating pin 70 and receiving zone 52 is constructed to assure that arcuate pivoting forces acting upon activation pin 70 will cause valve member 26 to arcuately pivot relative to housing 27 of product dispensing valve assembly 21. A shown through the Figures, the particular configuration employed for this embodiment of the present invention comprises an "X"-shape or "T"-shape. However, any alternate configuration which will provide the same function can be employed.

Figure 15:
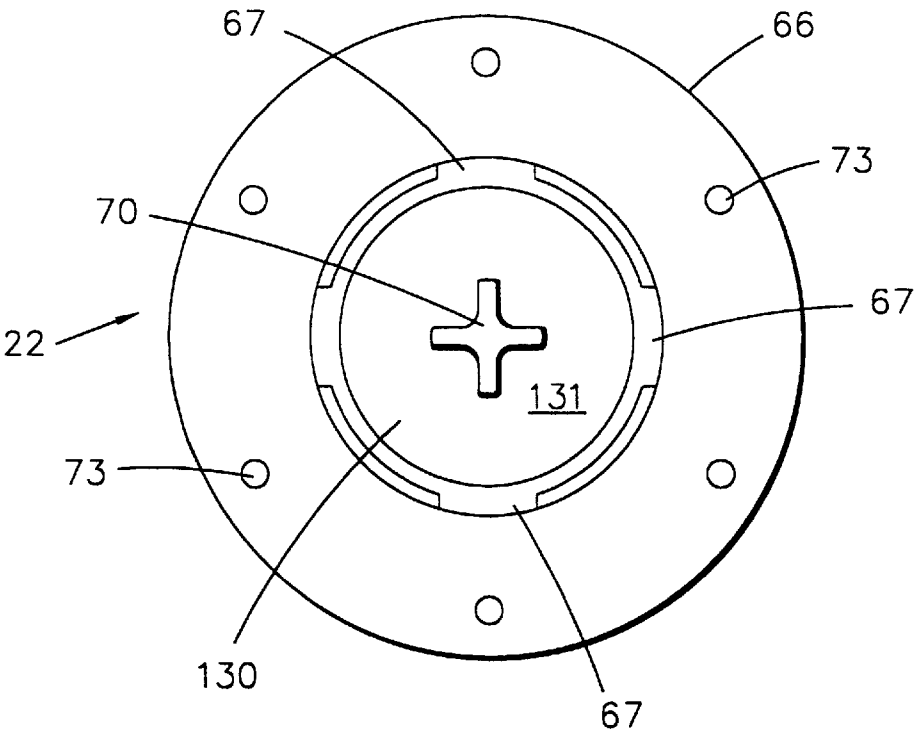
FIG. 15 is a top plan view of the tank adapter of FIG. 14.

In the embodiment depicted in FIGS. 13 and 15, activation pin 70 is formed with dimensions substantially equal to the size and shape of receiving zone 52 of valve member 26. In this embodiment, activation pin 70 is formed by two substantially identically shaped wall members constructed to intersect with each other substantially perpendicularly at their respective midpoints.

In order to position and maintain activation in 70 in the precisely desired location for entering receiving zone 50 of product dispensing valve assembly 21, while valve assembly 21 matingly engages with tank adapter 22, movable plate 130 is employed. In this embodiment, circular shaped support late 130 is mounted cooperatively associated with spring means 132 for providing a floating platform on which activation pin 70 is mounted extending upwardly therefrom. In this way, axial displacement of the floating platform is achieved for assuring secure, sealed, mounted engagement of product dispensing valve assembly 21 with tank adapter 22. In order to further enhance the sealed interengagement of the components, floating plate 130 may incorporate seal means 131 formed on the top surface thereof for contacting an sealing disk 56. In this way, assurance is provided that the transfer of the chemical directly into dilution tank/vessel 62 is achieved without having any chemical product being discharged into unwanted areas.

In this embodiment, base 65 incorporates an interior flange assembly 133 supportingly maintained within base 65 and positioned in juxtaposed, spaced, cooperating relationship with notches 67 and recesses 68. In addition, flange assembly 133 incorporates a lower terminating edge 134 which is constructed for mating, sealing engagement with movable plate or platform 130.

In the preferred embodiment, lower edge 134 and movable plate 130 are each constructed with beveled or chamfered ends in order to assure contacting, sealing interengagement therebetween. In addition, sealing means such O-ring 135 is preferably mounted to the edge of movable plate 130 in order to further assure secure, sealed engagement of movable plate 130 with lower edge 134 of flange assembly 133.

By employing this construction and arranging moveable plate/platform 130 with spring means 132 which of biases 130 into engagement with flange assembly 133, adapter 22 is normally maintained in a closed and sealed configuration. However, whenever valve assembly 21 is matingly inserted into contact with tank adapter 22, movable plate 130 is displaced out of engagement with flange assembly 133, causing a gap to be formed between plate 130 and lower edge 134 of flange assembly 133. Once adapter 22 is open and the gap is formed, any desired chemical is capable of flowing from its storage tank into the dilution vessel to which adapter 22 is mounted.

Figure 16:
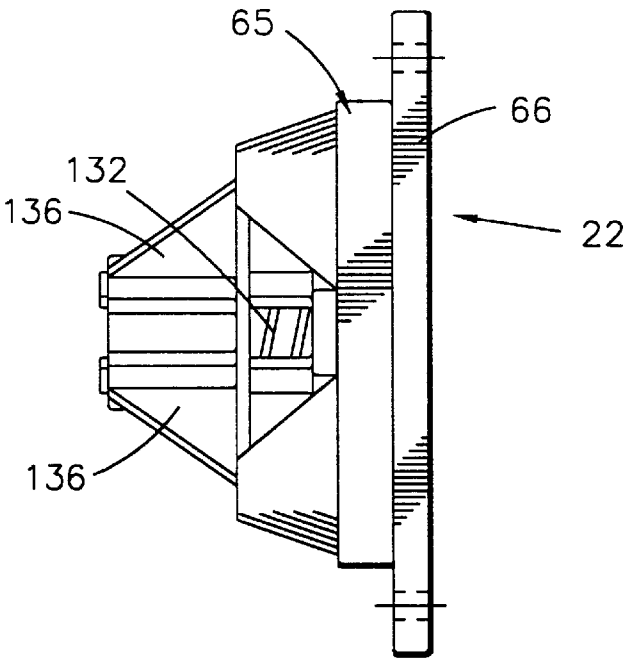
FIG. 16 is a side elevation view of the tank adapter of FIG. 14.

In addition, as best seen in FIG. 16, base 65 incorporates a plurality of open zones 136 which are in direct communication with the lower surface of movable plate 130. As result, whenever plate 130 has been dislodged from sealed engagement with flange assembly 133, any chemical flowing between plate 130 and flange assembly 133 is able to flow through base 65 by passing through open zones 136. In this way, the desired transfer of the chemical from storage container 60 directly into the dilution vessel is achieved.

By employing this alternate embodiment of the present invention, the telescopic interengagement of product dispensing valve assembly 21 with tank adapter 22 causes activation pin 70 of tank adapter 22 to enter receiving zone 52 of valve member 26 while locking fins or tabs 50 telescopically engage within notches 67 of tank adapter 22. Once plate portion 36 of product dispensing valve assembly 21 is fully engaged with tank adapter 22, product dispensing valve assembly 22 is arcuately pivoted to cause locking fins or tabs 50 to enter channels or recesses 68 of tank adapter 22.

During this arcuate pivoting movement, housing 27 is able to arcuately move as part of product dispensing valve assembly 21, while valve member 26 is incapable of arcuate movement due to its secure interengagement with activation pin 70 through receiving zone 52. As a result, as fully detailed above, valve member 26 is forced to axially advance relative to housing 27 of product dispensing valve assembly 21, longitudinally moving from its closed and sealed position to its open position. In order to assure that valve member 26 is able to axially advance away from housing 27 and effectively open product dispensing valve assembly 21, activation pin 70 is mounted on movable plate 130 which accommodates the axial movement of valve member 26 relative to housing 27 and simultaneously causes adapter 22 to be opened.

As is evident from the foregoing detailed disclosure, product dispensing valve assembly 21 and tank adapter 22 combine to provide a unique distribution system 20 enabling any desired chemical product to be transferred from storage container 60 into a mixing or dilution tank/vessel in a completely controlled manner, wherein only the dilution tank/vessel having the appropriate mating tank adapters 22 are capable of receiving the chemical product. Furthermore, by employing this construction, a completely controlled, spill-free transfer of all of the chemical product into the tank/vessel is realized.

As discussed above, in the preferred construction of the present invention, threaded retaining ring 30 of product dispensing valve assembly 21 is mounted to container 60 in a manner which prevents threaded retaining ring 30 from being removed from container 60. As a result, product dispensing valve assembly 21 is not capable of being removed and employed on alternate containers. Similarly, container 60 itself is not separately usable for any other products or purpose. In this way, controlled distribution of toxic chemicals in container 60 is provided.

In the preferred operation, container 60, with product dispensing valve assembly 21 securely affixed thereto, is employed for one single operation and then transferred to a recycling center capable of recycling the material from which container 60 and valve assembly 21 are formed. However, in order to prevent any contamination from occurring in the recycling of container 60 due to the retention of unwanted chemicals therein, container 60 must be adequately rinsed clean before transfer to a recycling center. In order to enable container 60 to be properly cleaned of any remaining chemical product while valve assembly 21 is securely mounted thereto, a cooperating, rinsing head 150.

Figure 29:
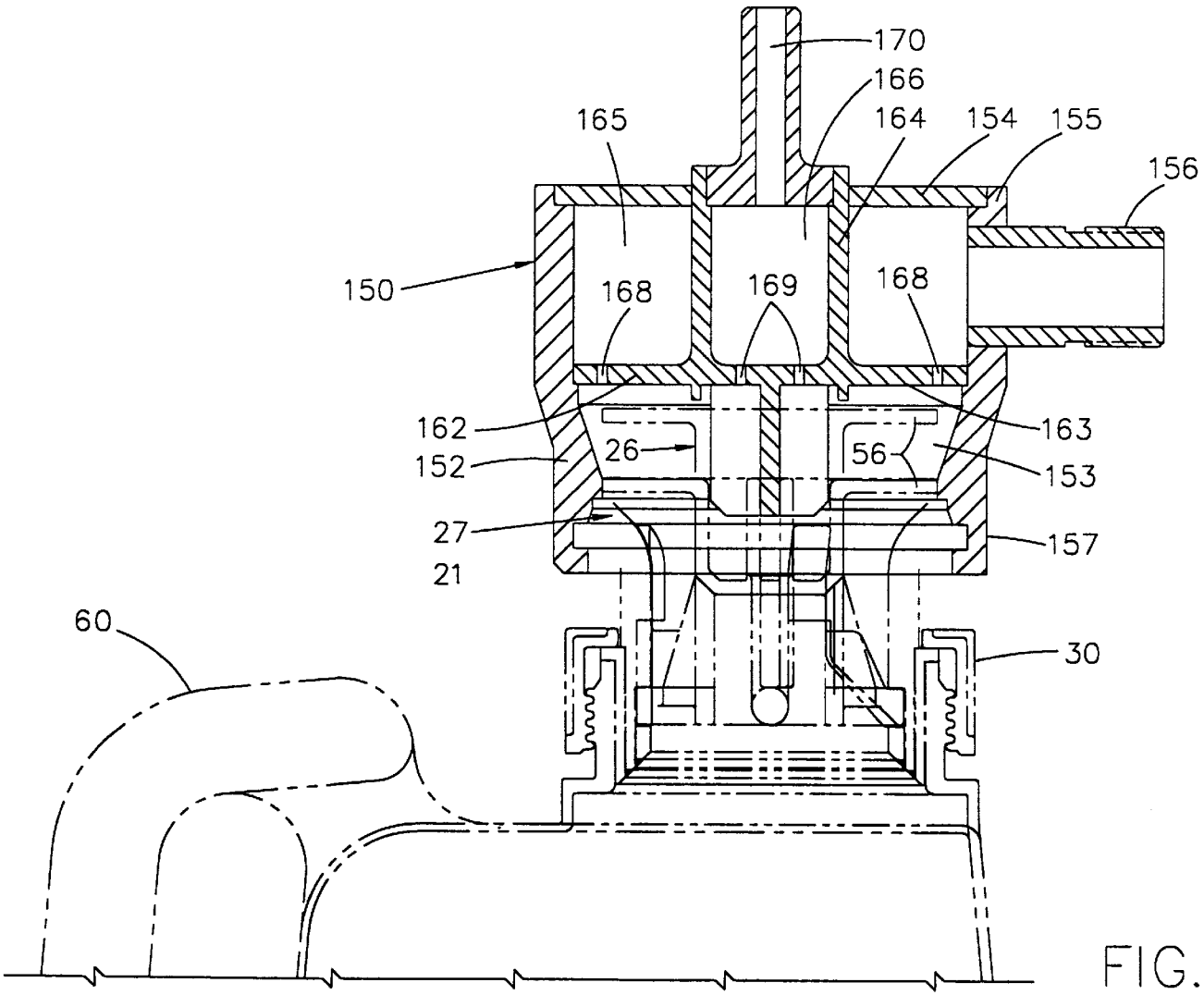
FIG. 29 is a cross-sectional side elevation view of one embodiment of a rinsing head forming a part of the present invention and depicted mounted to a product dispensing valve assembly and container, both of which are shown in phantom.
Figure 31:
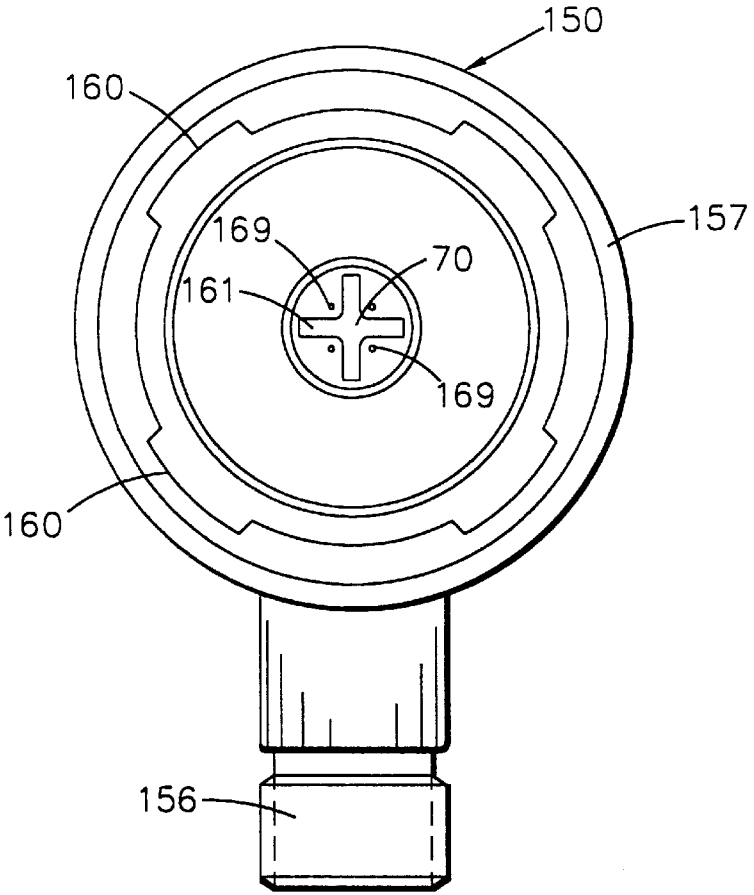
FIG. 31 is a bottom plan view of the rinsing head of FIG. 29.
Figure 30:
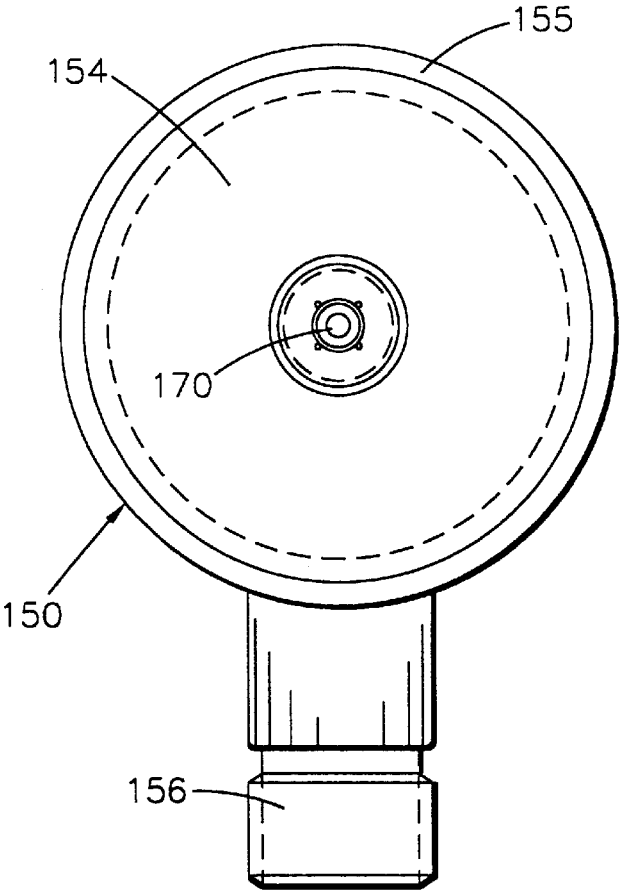
FIG. 30 is a top plan view of the rinsing head of FIG. 29.

In one preferred embodiment of the present invention, as shown in FIGS. 29–31, rinsing head 150 comprises a cooperating construction which is quickly and easily interconnected with product dispensing valve assembly 21. In addition, rinsing head 150 is capable of maintaining product dispensing valve assembly 21 in its open position while fully engaged therewith. As a result, by activating a water supply connected to rinsing head 150, water is easily transferred directly into container 60 through open valve assembly 21, enabling the desired cleansing of container 60 to be easily achieved.

By employing the present invention, a completely controlled, closed loop chemical distribution system is attained, wherein chemicals are transferred from a storage container to a dilution vessel only when authorized, cooperating components are employed. Furthermore, by employing the present invention, all chemicals are transferred in a controlled, spill-free operation, virtually eliminating any release of toxic or concentrated chemicals into the environment and/or surrounding areas.

Since it is contemplated that all empty containers 60 will be returned for recycling, the elimination of any and all residual chemicals from container 60 is desired. Consequently, container rinsing head 150 has been created and constructed for mating, activating engagement with valve assembly 21. By referring to FIGS. 29–34, two alternate constructions for rinsing head 150 are depicted.

In the first embodiment, depicted in FIGS. 29–31, rinsing head 150 comprises housing 152 with a substantially hollow interior zone 153, and a cover plate 154, closing and substantially sealing interior 153 at upper end 125. In addition, water delivery connector 156 is mounted to housing 122 and constructed for being easily connected to a conventional hose or other water delivery system. In this way, water is fed into interior 153 when desired.

In addition, housing 152 comprises a lower end 157 which is constructed for mating engagement with valve assembly 21 and controlled activation of valve member 26. In this regard, housing 152 incorporates notches 160 for cooperating with locking fins 50 of housing 27 as well as pin member 161 for insertion in receiving zone 52 of valve 26. As detailed above in reference to the mounting of valve assembly 21 with adapter 22, rinsing head 150 is mounted to valve assembly 21 in the same manner and arcuately pivoted to lock valve assembly 21 in place and activate valve member 26. Once valve member 26 is open, the desired rinsing of container 60 is easily achieved.

In order to provide the requisite delivery of the water to container 60 through open valve member 26, housing 152 incorporates a chamber forming insert plate 162 mounted in interior zone 153. Chamber forming plate comprises a substantially flat portion 163 mounted substantially parallel to cover plate 153 and a substantially cylindrical portion 164 centrally formed on plate 163 and extending from plate 162 to cover 154. In this way, two separate and distinct chambers 165 and 166 are formed.

In this embodiment, chamber 165 receives the water from delivery connection 156 and enables the water to flow about annular shaped chamber 165. As shown in FIG. 29, plate 163 incorporates holes 168 which are preferably positioned beyond the terminating edge of valve 26, thereby enabling the water to easily flow from chamber 165 through holes 168 and into valve assembly 21 and container 60. In order to assure the free flow of water into container 60, apertures 169 are formed adjacent pin member 161 as air vents to the air in container 60 to be displaced by the water. Upon passing through apertures 169, the air enters chamber 166 and then exits through channel 170.

Once a sufficient amount of water has been added to container 60, the water supply is stopped and rinsing head 150 is removed. Then, container 60 is mounted to the dilution vessel and once valve 26 is opened, the water in container 60 is emptied into the dilution vessel by passing through valve 26 and adapter 22.

By employing this construction, container 60 is easily rinsed clean with the rinsed water being added directly to the dilution vessel. In addition, if additional rinsing cycles are required, the process detailed above is repeated as desired.

Figure 32:
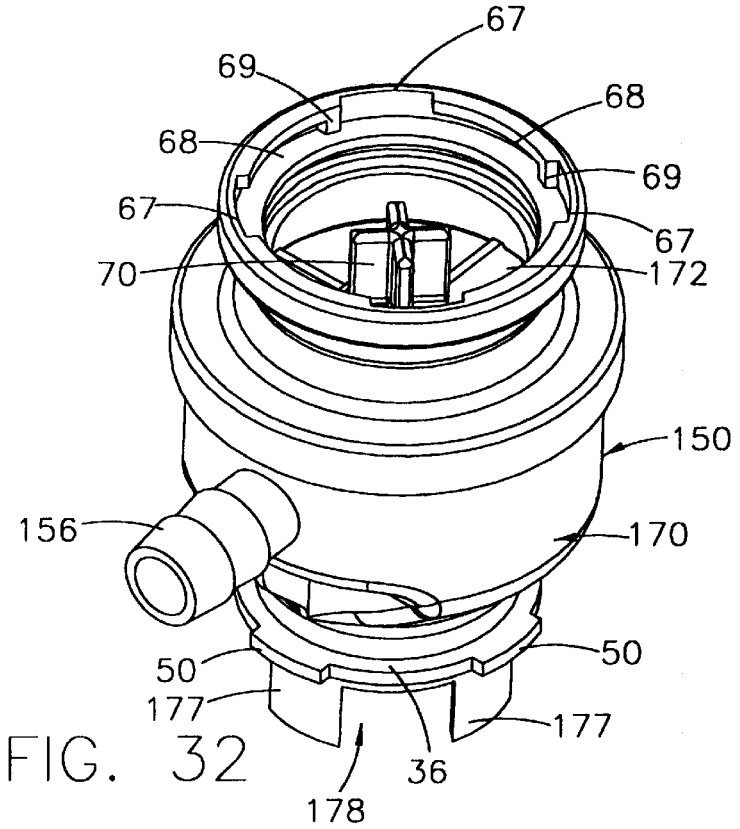
FIG. 32 is a perspective view of an alternate embodiment of a rinsing head which forms a part of the present invention.
Figure 33:
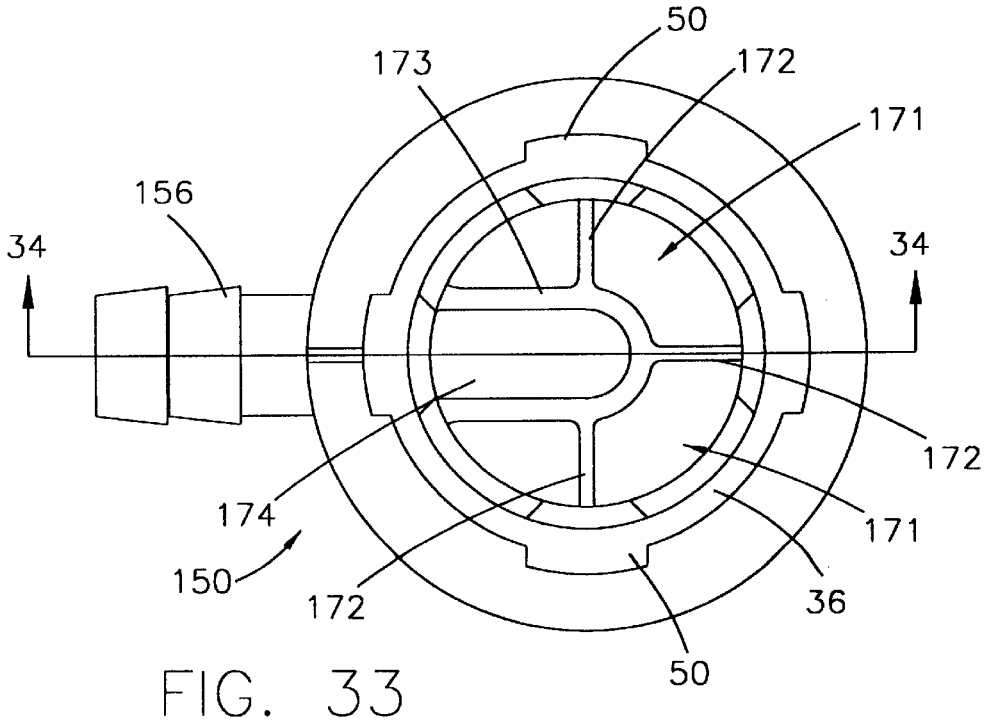
FIG. 33 is a bottom plan view of the rinsing head of FIG. 32.
Figure 34:
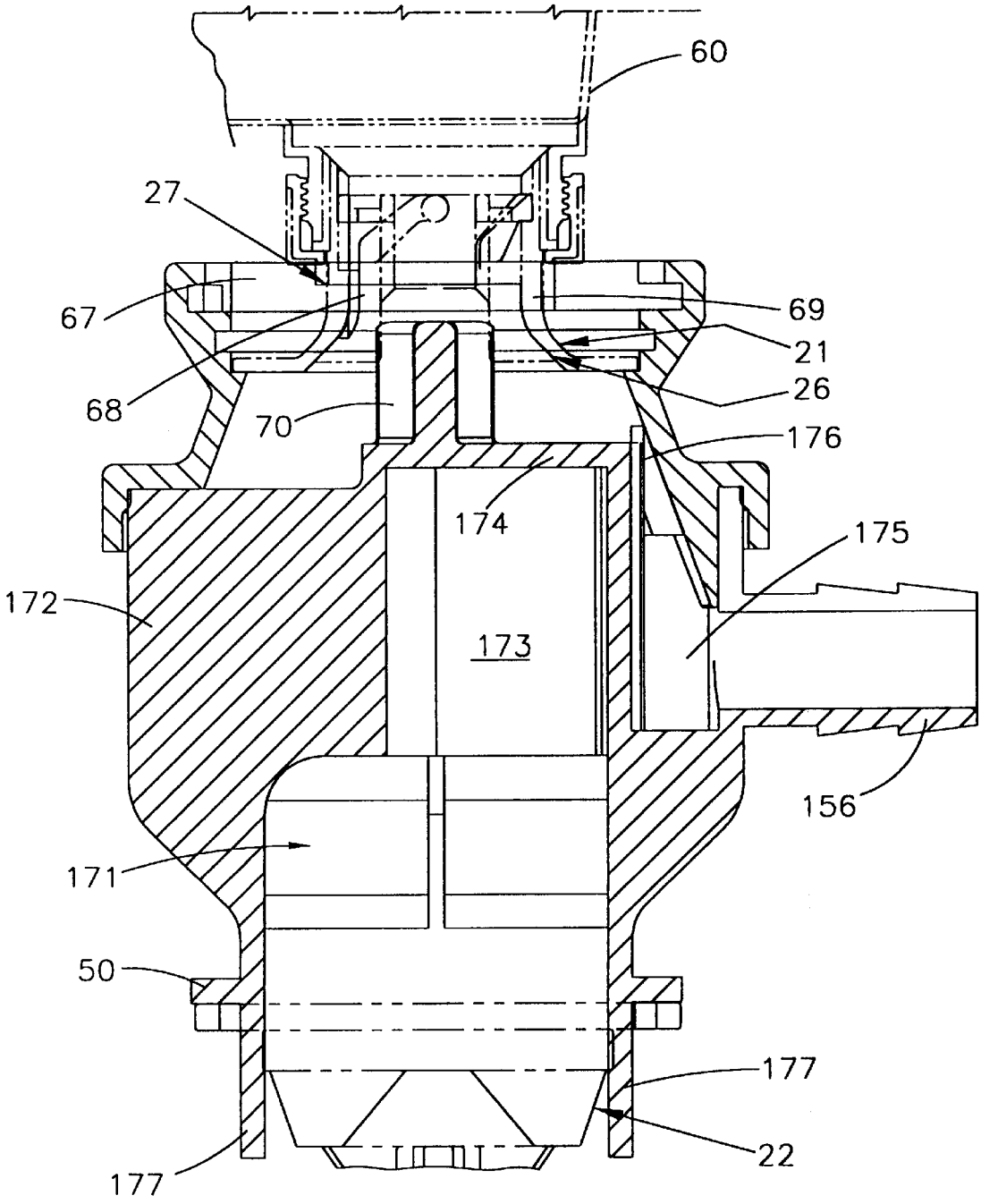
FIG. 34 is a cross-sectional side elevational view taken along line 34—34 of FIG. 33.
Figure 35:
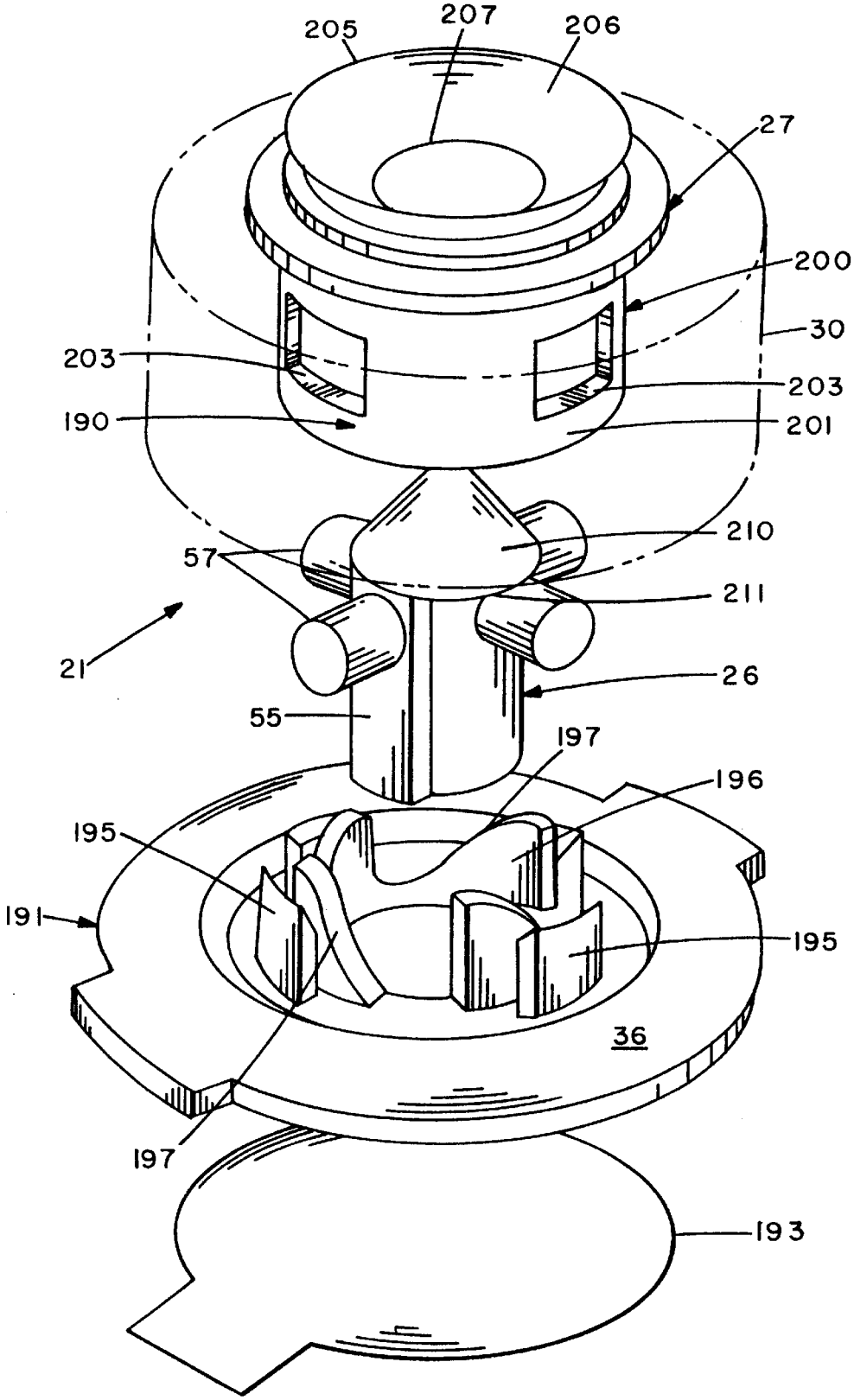
FIG. 35 is an exploded perspective view of a further alternate embodiment of a product dispensing valve assembly of the present invention, specially constructed for use with dry chemical products.

By referring to FIGS. 32–34, along with the following detailed disclosure, the construction and operation of an alternate embodiment for rinsing head 150 of the present invention can best be understood. As fully detailed below, in this embodiment, rinsing head 150 is constructed for cooperative mounted engagement with both product dispensing valve assembly 21 and tank adapter 22.

By employing this construction, container 60 with valve assembly 21 is mountable directly to an upper portion of rinsing head 150 while the lower portion of rinsing head 150 is mounted directly to tank adapter 22. In this way, the chemical material stored in container 60 is able to be transferred through product dispensing valve assembly 21, rinsing head 150, and tank adapter 22 into the dilution vessel on which tank adapter 22 is mounted. Then, once all of the chemical material has been transferred into the dilution vessel, the rinse water is turned on, enabling container 60 to be completely cleaned, with the rinse water automatically draining through rinsing head 150 into the dilution vessel. As a result, a completely closed loop, one step, easily employed, controlled distribution and cleaning system is realized.

In the following detailed disclosure, like numerals are employed for similar components in accordance with the practice previously established in this disclosure. In this way, these common elements are more easily understood.

In order to provide the construction results detailed above, this embodiment of rinsing head 150 incorporates housing 170 which comprises interior chamber 171. Inside interior chamber 171, activation pin 70 is supportingly maintained. Although activation pin 70 may be supported in a wide variety of alternate constructions, the preferred construction employs a plurality of vertically disposed, flat support panels 172 and a substantially U-shaped, vertically disposed support member 173.

This construction, which is best seen in FIGS. 33 and 34, incorporates U-shaped support member 173 with vertical panels 172 radially extending outwardly from the curved zone thereof. In addition, horizontally disposed, flat plate 174 is mounted to the top edge of U-shaped support member 173 providing a flat surface on which activation pin 70 is supportingly maintained.

In addition, housing 170 incorporates water delivery connection 156 which functions as defined above in order to deliver water from a desired source directly to rinsing head 150. In this embodiment, water flow controlling chamber 175 is formed in housing 170, in direct communication with water delivery connection 156.

In addition, in the preferred embodiment, water flow controlling chamber 175 incorporates a single exit portal 176 formed at the upper end of chamber 175, in direct association with the position of open valve assembly 21. In this way as further detailed below, the precisely desired controlled water flow is provided directly through opened valve assembly 21 into inverted container 60 under sufficient force to enable the water to completely enter container 60 and flush out all chemical material retained therein.

Housing 170 of rinsing head 150 also incorporates a lower end formed by a plurality of separate and independent, vertically extending panels 177 formed in a substantially circular array. In the preferred construction, four separate and independent panels 177 are employed and are spaced apart equally from each other, with open zones 178 formed to therebetween. In addition, the lower portion of housing 170 also incorporates a flat plate portion 36 radially extending outwardly, positioned above panels 177. In addition, a plurality of locking fins 50 are formed radially extending outwardly from flat plate portion 36.

As clearly depicted in FIG. 34, locking fins 50 are constructed for cooperating, sliding, locking engagement with adapter 22 in order to provide the desired secure retained interengagement therewith. In addition, vertically extending panels 177 cooperate with either embodiment of adapter 22 in order to assure that adapter 22 is maintained in an open position.

As is evident from the foregoing, when this embodiment of rinsing head 150 is employed with the embodiment of adapter 22 which employs movable, spring biased plate/platform 130, vertically extending panels 177 assures that spring biased plate/platform 130 is moved into the open position, while open zones 178 assure that the chemical materials/compound and/or rinse water is capable of easily flowing through rinsing head 150 and adapter 22.

The construction of this embodiment of rinsing head 150 is completed by forming the upper end of housing 170 with a construction similar to adapter 22 in order to enable valve assembly 21 to be lockingly interengaged therewith while mating with activation pin 70. In this regard, as clearly shown in FIGS. 32 and 34, the upper end of housing 170 incorporates notches 67 formed about the top edge thereof, which cooperate with channels 68 and abutment stops 69. In this way, container 60 is capable of being mounted, in an inverted position, in direct, locked association with this embodiment of rinsing head 150, with valve assembly 21 of container 60 secured to rinsing head 150 while valve assembly 21 is maintained in the open position.

As is evident from the foregoing detailed discussion, this embodiment of rinsing head 150 enables container 60, with valve assembly 21 securely affixed thereto, to be mounted directly to rinsing head 150 while rinsing head 150 is interconnected with adapter 22 of the desired dilution vessel. In this way, once container 60 is mounted to rinsing head 150, valve assembly 21 is opened, enabling chemical material/compound stored therein to be directly added to the dilution vessel through valve assembly 21, rinsing head 150, and tank adapter 22.

Once all of the chemical materials/compounds have been transferred out of container 60, the water supply is turned on forcing pressurized water to flow into container 60, completely cleaning container 60 of any and all remaining chemical. By employing this embodiment, the cleaning water directly contacts the walls of container 60 and flows directly through valve assembly 21, rinsing head 150, adapter 22 and into the dilution vessel.

Once container 60 has been cleaned, the water supply is shut off and the completely cleaned container 60 with valve assembly 21, is removed from rinsing head 150, enabling the container to be recycled as a cleaned container. In addition, as is evident from the foregoing disclosure, this construction assures a completely controlled, closed loop, spill-free system wherein concentrated or toxic chemicals are capable of being easily handled, without any possibility of spillage or environmental fouling. Consequently, all of the objectives and goals of the present invention are hereby attained.

In the sale and distribution of chemical materials and compounds which are employed by having the user dilute the chemical materials/compounds from a concentrated form to a form usable for application to a particular area and/or surface, the handling of the concentrated chemical materials/compounds during transfer from a storage container to a dilution vessel is an ever increasing area of concern. In particular, it has been found that unwanted spillage of concentrated chemicals has occurred with deleterious effects to the environment. Consequently, substantial effort has been expended in preventing spillage and assuring that only authorized individuals are capable of gaining access to the concentrated chemicals in transferring the concentrated chemicals from the storage container to a dilution vessel.

In this regard, although substantial concern has been directed to liquid compositions, with the embodiments detailed above being specifically constructed for transferring concentrated liquid chemical materials/compounds from a storage container to a dilution vessel, the transfer and handling of solid chemicals is another area in which the same concerns must be addressed. These concerns are most critical in handling chemical materials/compounds which are sold and distributed in powder form, pellet form, or other dry-flowable form. In order to provide a system which is capable of satisfying the requirements of this area and is capable of achieving controlled, spilled-free transfer of dry chemical materials/compounds from a storage container to a dilution vessel, controlled distribution system 20 has been developed.

As shown in FIGS. 35–38, this embodiment of controlled distribution system 20 incorporates product dispensing valve assembly 21 and tank adapter 22. In general, tank adapter 22 is constructed in the manner substantially identical to the tank adapters detailed above and fully disclosed herein. However, as will be evident from the following detailed disclosure, tank adapter 22 employable with this embodiment of valve assembly 21 incorporates a pin member constructed for entering the embodiment for receiving zone 52 and activating valve member 26.

In the preferred construction of this embodiment of the present invention, product dispensing valve assembly 21 comprises valve member 26 cooperatively associated with housing 27. In this embodiment, housing 27 is formed by the mating, interconnected interengagement of upper housing member 190 and lower housing member 191. Once upper housing member 190 and lower housing member 191 are mounted in locked interengagement with each other to form housing 27, cam tracks 45 are constructed for providing the desired guiding, arcuate pivoting and axial/longitudinal movement of valve member 26 relative thereto.

In order to attain the desired results, lower housing member 191 incorporates substantially flat plate portion 36 with radially extending tabs or fins 50 integrally formed therewith. In addition, plate portion 36 peripherally surrounds and is integrally connected with support plate 192. Furthermore, removable tamper-evident sealing cover 193 is preferably affixed to support plate 192, closing and sealing the entry to valve assembly 21 until opened by the user.

Lower housing member 191 also incorporates a plurality of upstanding locking fingers 195 extending from support plate 192 positioned in a substantially circular array. In the preferred construction, four separate and independent locking fingers 195 are employed, with each locking finger being arcuately spaced equally from each adjacent finger.

The overall construction of lower housing member 191 is completed by incorporating substantially circular shaped insert member 196, which is constructed with curved, sloping, cam-forming edges 197. Circular shaped insert member 196 comprises a diameter less than the diameter formed by the circular array of locking fingers 195 and is positioned co-axially therewith. Consequently, locking fingers 195 peripherally surround and are equally spaced away from insert member 196 with a spaced distance that enables upper housing member 190 to be inserted therebetween.

Upper housing 190 comprises a substantially cylindrically shaped tube portion 200 which comprises an outer wall 201 and an inner wall 202. In addition, a plurality of cut-away or recess zones 203 are formed in outer wall 201, in substantially peripheral surrounding relationship therewith. In the preferred construction, four separate and independent cut-away or recess zones 203 are formed in outer wall 201 and are positioned in substantially equally spaced relationship to each other. In addition, each cut-away zone 203 is dimensioned for cooperative interlocking engagement with one locking finger 195 of lower housing member 191. In this way, the desired secure interlocked interengagement of upper housing member 190 and lower housing member 191 is achieved.

Upper housing member 190 also incorporates a plurality of cam surface defining elements 41 formed on inner wall 202, with each cam surface defining element 41 incorporating a cam track/ledge portion 42. As with the embodiments detailed above, cam track/ledge portion 42 of cam surface defining elements 41 are each constructed for cooperating with cam-forming edge 197 of insert member 196 to form cam track 45 when upper housing member 190 and lower housing member 191 are in locked interengagement with each other. In addition, these elements cooperate with the outside surface of valve member 26 to form flow path 212 through which the desired chemical can pass when enabled.

In order to provide a construction which is specially designed for use in dispensing dry chemical materials/compounds, tube portion 200 is constructed with one end thereof incorporating a truncated conical shaped surface 206. In the preferred construction, truncated, conical surface 206 provides a smooth, continuous, sloping, funnel surface extending from upper edge 205 to terminating edge 207. In the preferred embodiment, truncated conical, funnel-like surface 206 is integrally interconnected with tube portion 200 by flange 208, which extends from terminating edge 207 to inside wall 202 of tube portion 200. In this way, a continuous, intergrallly formed component is attained with truncated conical shaped, funnel-like surface 206 providing controlled feeding of the chemical material into the valve assembly.

In order to provide the desired sealing engagement of valve member 26 with housing 27, in a manner which prevents any chemical material/compound stored in container 60 from passing through valve assembly 21 prior to actual activation of valve member 26 relative to housing 27, valve member 26 in this embodiment of the present invention comprises a unique construction. Although alternate sealing arrangements can be employed without departing from the scope of the present invention, the preferred embodiment incorporates sealing surface 210, preferably in the form of a cone, as the terminating end surface of valve member 26. In this construction, sealing surface 210 is mounted to central section 55 of valve member 26 at the end opposite from the entry to pin-receiving zone 52.

Figure 36:
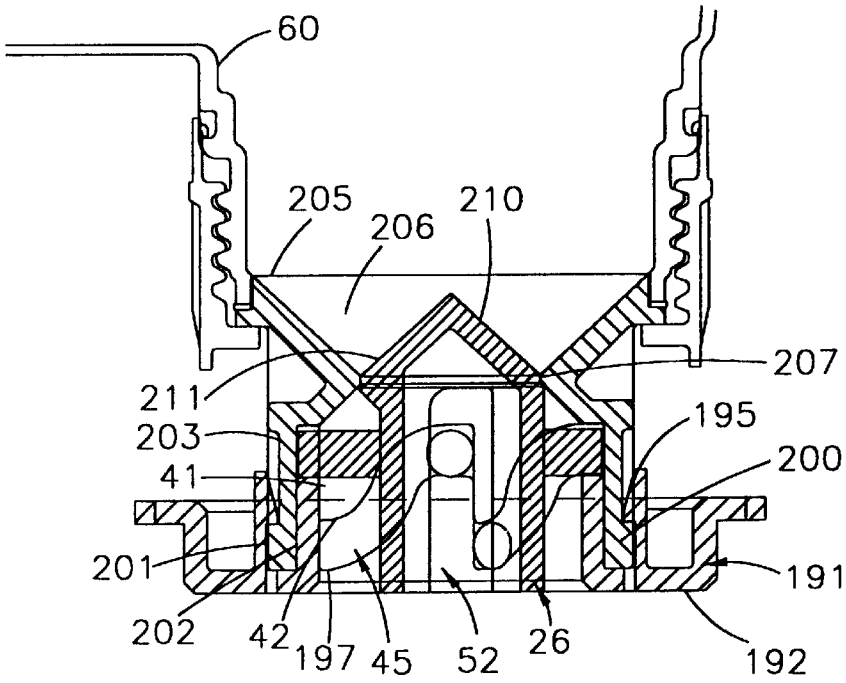
FIG. 36 is a cross-sectional side elevation view of the valve assembly of FIG. 35 shown in its closed position.
Figure 38:
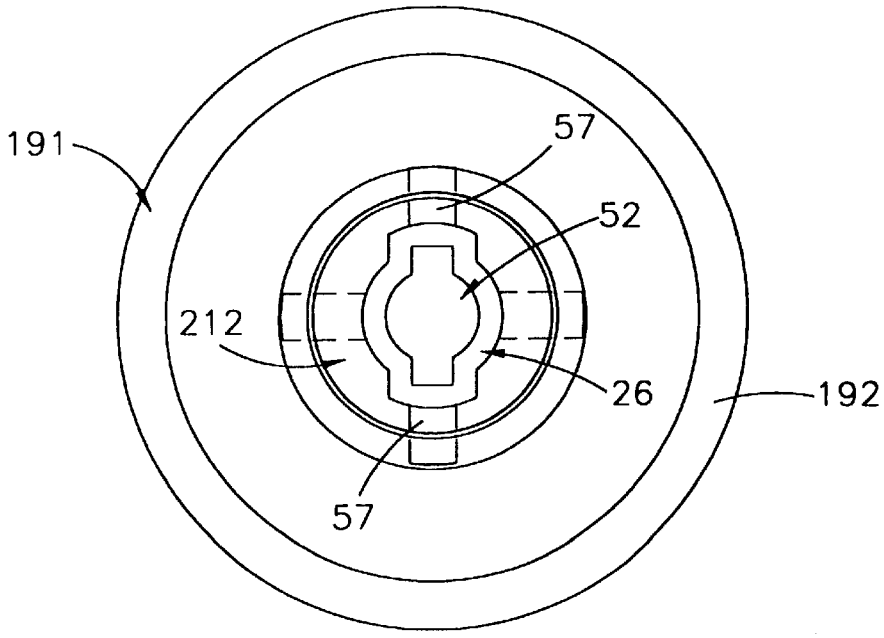
FIG. 38 is a bottom plan view of the valve assembly of FIG. 35.
Figure 37:
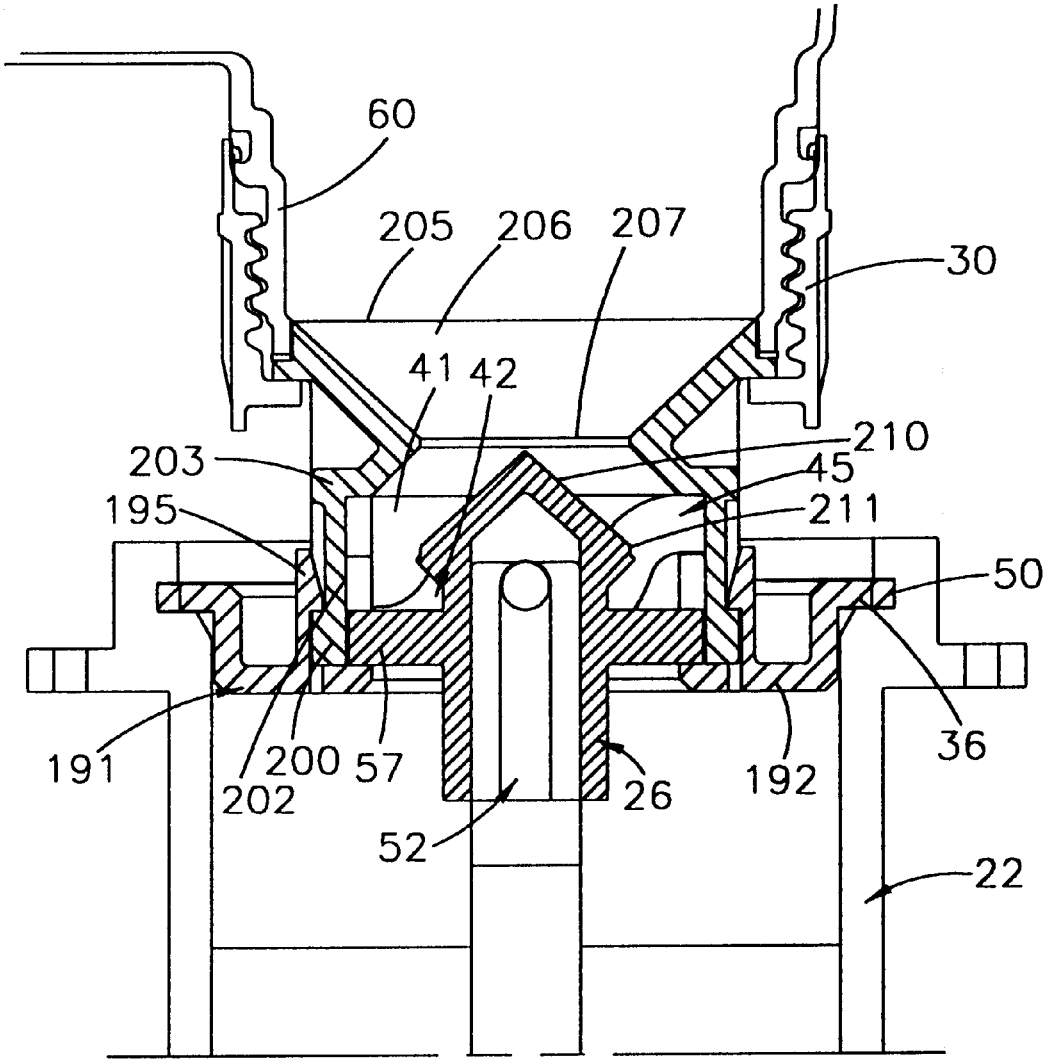
FIG. 37 is a cross-sectional side elevation view of the valve assembly of FIG. 35 shown in its open position.

As clearly shown in FIGS. 36 and 37, sealing surface 210 is constructed with a sloped angle which enables sealing surface 210 to pass through terminating edge 207 and be positioned in spaced alignment with conical surface 206 of housing 27. In addition, the diameter of terminating edge 211 of sealing surface 210 is constructed for mating, sealing engagement with terminating edge 207 of conical surface 206. In this way, when valve member 26 is in its closed and sealed position, as depicted in FIG. 36, any chemical material stored in container 60 is incapable of passing through valve assembly 21, due to the sealed engagement between edge 211 of sealing surface 210 and terminating edge 207 of conical surface 206.

As clearly depicted in FIG. 37, when this embodiment of valve assembly 21 is placed in association with adapter 22, the pin member thereof is able to enter pin receiving zone 52 of valve member 26 and container 60 is able to be arcuately pivoted in the manner detailed above. This arcuate movement causes locked interengagement of valve member 21 with adapter 22, while also simultaneously causing valve member 26 to be activated. When activated, valve member 26 simultaneously moves longitudinally and arcuately, advancing due to the controlled movement of radially extending fingers 57 of valve member 26 in cam tracks 45 of housing 27.

This simultaneous arcuate pivoting and axial/longitudinal movement of valve member 26 relative to housing 27 causes edge 211 of sealing surface 210 to be moved out of interengagement with terminating edge 207 of conical surface 206, thereby creating a gap therebetween. Once this gap has been formed, the chemical materials/compounds stored in container 60 are capable of passing through conical surface 206, sealing surface 210 and into the dilution vessel by passing through flow path 212 formed between valve member 26 and housing 27. In addition, the sloping surface 210 cooperates with conical, funnel-like surface 206 to controllably guide the chemical material from the container and through the valve assembly. In this way, only authorized placement of product dispensing valve assembly 21 of the present invention with adapter 22 will enable valve assembly 21 to be opened and allow the chemical to be transferred as desired into the dilution vessel.

In constructing a product dispensing valve assembly which is capable of being successfully employed with solid materials as powders, pellets, dry flowables, or any other form, it is important that the sealing surfaces are not merely compression surfaces which cause the product to be squeezed between two elements. When a sealing system of that nature is employed, it has been found that improper sealing and product leakage can result.

In the present invention, this result is avoided by providing a wiping action between cooperating sealing edges 207 and 211, as these components arcuately pivot relative to each other whenever sealing is desired. As result, the sliding, arcuate pivoting movement causes a wiping action, preventing unwanted squeezing of the product between the sealing surfaces, and further assuring a system capable of providing trouble-free operation.

Furthermore, in this embodiment, collar 30 is securely mounted in captured engagement with valve member 26 and housing 27 in a manner substantially identical to the mounted engagement detailed above. In addition, in the preferred construction, collar 30 is secured to container 60 in a manner which prevents the removal of collar 30 from container 60. In this way, access to the chemicals stored in container 60 is limited to only authorized individuals with authorized equipment.

It will thus be seen that the objects set forth above among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

What is claimed is:

1. A fully controlled distribution process for preventing spillages, mis-use and/or mishandling in the unpressurized, gravity feed distribution of chemical products, said process comprising the steps of:

A. distributing chemical products in closed and sealed containers incorporating a closed and sealed valve assembly which is non-removably mounted to the container, is openable with only authorized actuators, and is capable of being re-closed and re-sealed, if desired, said valve assembly comprising a collar securely affixed to the container, a housing cooperatively associated with the collar and comprising a plurality of cam tracks formed therein for controlled, cooperating engagement with a valve member by defining a travel path for said valve member, and a valve member positioned within the housing and constructed for cooperative, arcuate, pivoting and axially longitudinal movement relative thereto, said movement being controlled by the engagement of radially extending, fingers in the cam the tracks of the housing;

B. securely affixing an adapter to a dilution vessel incorporating an authorized actuator integrally formed thereon and constructed for mating, locking engagement with the valve member of the valve assembly;

C. transferring the closed, sealed product bearing container to a user;

D. mounting the container bearing the valve assembly onto the adapter by telescopically inserting and interengaging the valve member of the valve assembly with the adapter;

E. arcuately pivoting the container and valve assembly relative to the adapter and the dilution vessel in a first direction for causing the valve member of the valve assembly to arcuately pivot relative to the housing in the cam tracks thereof, while simultaneously moving axially from a closed position to an open position;

F. dispensing the chemical products from the container through the valve assembly and the adapter into the dilution vessel;

G. arcuately pivoting the container and valve assembly relative to the adapter and the dilution vessel in a second direction for causing the valve member of the valve assembly to arcuately pivot relative to the housing in the cam tracks thereof, simultaneously moving axially from the open position to the closed position;

H. removing the container with the valve assembly from the adapter for recycling; and I. diluting the concentrated chemical in the dilution vessel by adding water thereto.

2. The method defined in claim 1 comprising the additional step of

J. rinsing the container prior to removal from the adapter to assure a completely clean, product-free container prior to recycling.

3. The fully controlled distribution process defined in claim 1, wherein a plurality of product dispensing valve assemblies are separately and individually mounted to a plurality of containers in a manner which prevents each product dispensing valve assembly from being removed from its associated container by unauthorized individuals.

4. The fully controlled distribution process defined in claim 1, wherein each product dispensing valve assembly comprises lock means for maintaining the valve assembly in its closed position until telescopically mounted to an elongated activation pin formed on the adapter and arcuately pivoted relative thereto for moving the valve member of the valve assembly from its closed, locked position to its open position.

5. The fully controlled distribution process defined in claim 4, wherein each valve member of each valve assembly arcuately pivots and simultaneously moves axially along the activation pin of the adapter during the opening and closing process.

6. The fully controlled distribution process defined in claim 4, wherein each adapter incorporates holding means for preventing the removal of the valve assembly from the adapter once the valve member of the valve assembly has been moved into its open position.

7. The fully controlled distribution process defined in claim 1, wherein each valve assembly further comprises a water receiving inlet port and the process comprises the additional steps of:

K. securely affixing a water delivery conduit to the water receiving inlet port of the valve assembly; and L. activating the water supply for effectively delivering water to the interior of the valve assembly and the container affixed to thereto, for rinsing the container prior to its removal.

8. The fully controlled distribution process defined in claim 7, wherein the rinsing valve assembly further comprises water delivery means formed in therein for assuring delivery of the water to the interior of the valve assembly and the interior of the container, thereby assuring complete rinsing of the container of all toxic material.

9. The fully controlled distribution process defined in claim 8, comprising the additional steps of:

M. removing the rinsed container from the adapter; and

N. disposing of the thoroughly rinsed container in the normal manner for recycling with complete assurance that all toxic chemicals originally retained in the container are completely removed.

10. The fully controlled distribution process defined in claim 1, wherein said valve member further comprises a plurality of radially extending fingers, each being separately mounted in one of said cam tracks formed in the housing and constructed for movement in said cam tracks, thereby controlling the simultaneous arcuate pivoting movement and axially longitudinal movement of the valve member relative to the housing.

11. The fully controlled distribution process defined in claim 10, wherein said housing comprises a sealing surface integrally formed therein and said valve member incorporates a sealing edge constructed for mating, sealing engagement with the sealing surface of the housing for preventing passage of any material when the valve member is in its closed position and allowing passage of the material when the valve member is in its open position.

12. The fully controlled distribution process defined in claim 1, wherein said product is defined as comprising one selected from the group of liquids and dry flowable materials.

* * * * *